US010129665B2

(12) United States Patent
Miller

(10) Patent No.: US 10,129,665 B2
(45) Date of Patent: Nov. 13, 2018

(54) DISTRIBUTED RESONATOR

(71) Applicant: Cochlear Limited, Macquarie University, NSW (AU)

(72) Inventor: Scott Allen Miller, Lafayette, CO (US)

(73) Assignee: Cochlear Limited, Macquarie University, NSW (AU)

( * ) Notice: Subject to any disclaimer, the term of this patent is extended or adjusted under 35 U.S.C. 154(b) by 725 days.

(21) Appl. No.: 14/547,474

(22) Filed: Nov. 19, 2014

(65) Prior Publication Data

US 2015/0141740 A1 May 21, 2015

Related U.S. Application Data

(60) Provisional application No. 61/906,981, filed on Nov. 21, 2013.

(51) Int. Cl.
*H04R 25/00* (2006.01)

(52) U.S. Cl.
CPC ..... *H04R 25/606* (2013.01); *H04R 2460/13* (2013.01)

(58) Field of Classification Search
CPC .. H04R 25/00–25/75; H04R 2460/00–2460/17
See application file for complete search history.

(56) References Cited

U.S. PATENT DOCUMENTS 6,438,243 B1 * 8/2002 Ikeuchi ..... H04R 15/02 367/181
6,759,790 B1 * 7/2004 Bugel ..... H02N 2/043 310/328
2003/0012390 A1 * 1/2003 Franks ..... A61N 1/36032 381/114
2009/0115294 A1 * 5/2009 Kikushima ..... H01L 41/04 310/370
2009/0124849 A1 * 5/2009 Pergola ..... H04R 25/606 600/25
2010/0298626 A1 11/2010 Andersson et al.
2013/0197298 A1 8/2013 Miller et al.
2014/0112503 A1 * 4/2014 Hebenstreit ..... H04R 1/00 381/151
2014/0163308 A1 6/2014 Miller et al.
2014/0303688 A1 * 10/2014 Kulah ..... A61N 1/3785 607/57

* cited by examiner

*Primary Examiner* — Thaddeus Cox
(74) *Attorney, Agent, or Firm* — Pilloff & Passino LLP; Martin J. Cosenza

(57) ABSTRACT

A device, including a vibratory apparatus having an actuator configured to generate vibrations upon actuation of the actuator, including plurality of lever arms, wherein the vibratory apparatus is configured such that at least a respective portion of respective lever arms of the plurality of lever arms move about at least one of a single or a respective hinge when the vibratory apparatus is generating vibrations.

29 Claims, 26 Drawing Sheets

DISTRIBUTED RESONATOR

CROSS-REFERENCE TO RELATED APPLICATIONS

This application claims priority to Provisional U.S. Patent Application No. 61/906,981, entitled DISTRIBUTED RESONATOR, filed on Nov. 21, 2013, naming Scott Allen MILLER of Boulder, Colo., as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In accordance with one aspect, there is a device, comprising a vibratory apparatus having an actuator configured to generate vibrations upon actuation of the actuator, including a plurality of lever arms, wherein the vibratory apparatus is configured such that at least a respective portion of respective lever arms of the plurality of lever arms move about at least one of a single or a respective hinge when the vibratory apparatus is generating vibrations.

In accordance with another aspect, there is a device, comprising a vibratory apparatus having an actuator configured to generate vibrations upon actuation of the actuator, including a plurality of lever arms, wherein the vibratory apparatus is configured such that respective lever arms of the plurality of lever arms resonate independently from each other when the vibratory apparatus is generating vibrations.

In accordance with another aspect, there is a device, comprising a vibratory apparatus having an actuator configured to generate vibrations upon actuation of the actuator, the vibratory apparatus including an effectively continuous spectrum of structural resonant frequencies.

BRIEF DESCRIPTION OF THE DRAWINGS

Some embodiments are described below with reference to the attached drawings, in which.

DETAILED DESCRIPTION

Figure 1A:
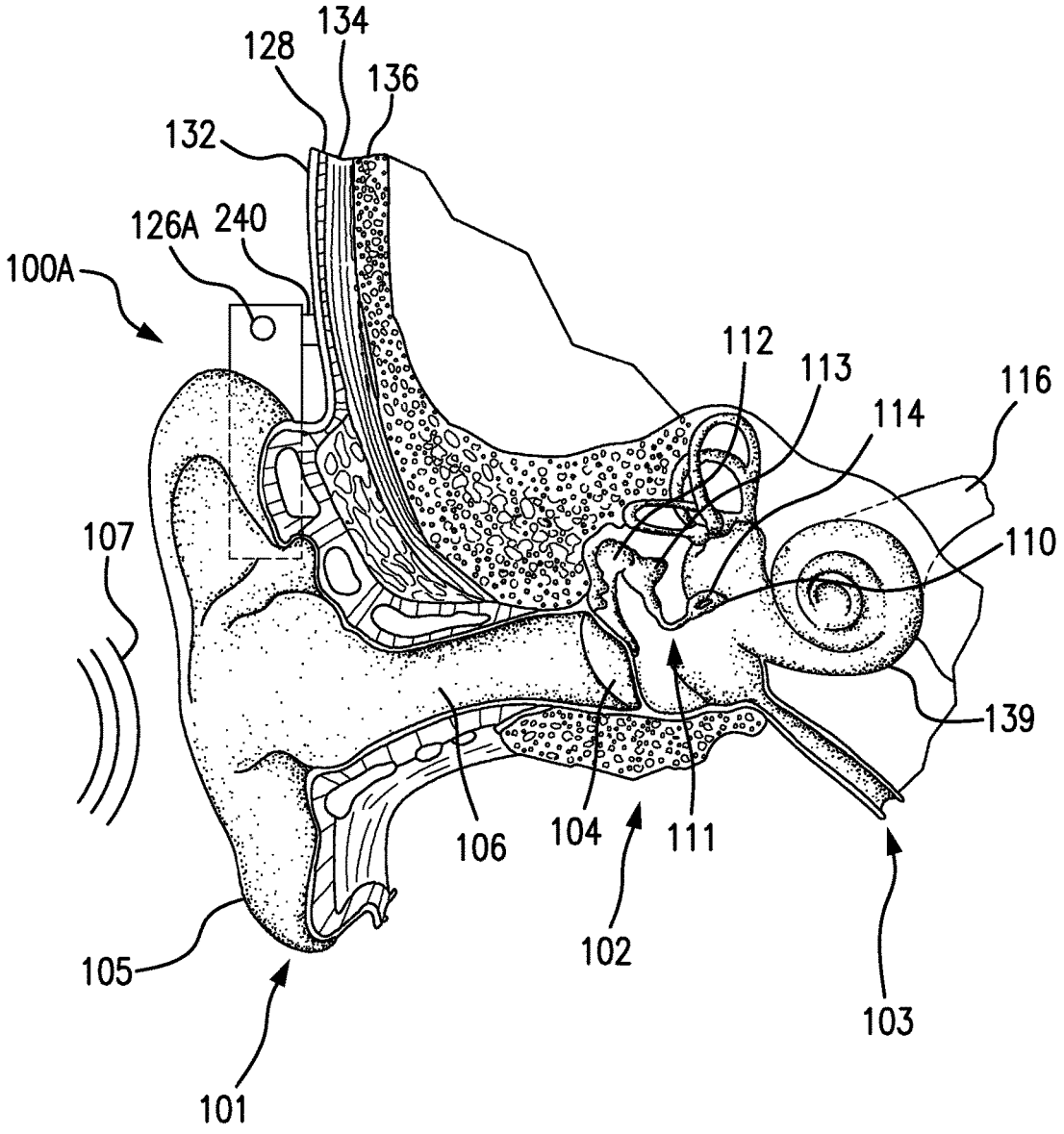
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1A also illustrates the positioning of bone conduction device 100A relative to outer ear 101, middle ear 102 and inner ear 103 of a recipient of device 100. As shown, bone conduction device 100 is positioned behind outer ear 101 of the recipient and comprises a sound input element 126A to receive sound signals. Sound input element may comprise, for example, a microphone, telecoil, etc. In an exemplary embodiment, sound input element 126A may be located, for example, on or in bone conduction device 100A, or on a cable extending from bone conduction device 100A.

In an exemplary embodiment, bone conduction device 100A comprises an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a species of the genus vibrator) and/or various other operational components, such as sound input device 126A. In this regard, the operationally removable component is sometimes referred to herein as a vibrator unit. More particularly, sound input device 126A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 240 configured to operationally removably attach the operationally removable component to a bone conduction implant (also referred to as an anchor system and/or a fixation system) which is implanted in the recipient. In the embodiment of FIG. 1, coupling assembly 240 is coupled to the bone conduction implant (not shown) implanted in the recipient in a manner that is further detailed below with respect to exemplary embodiments of the bone conduction implant. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

Figure 1B:
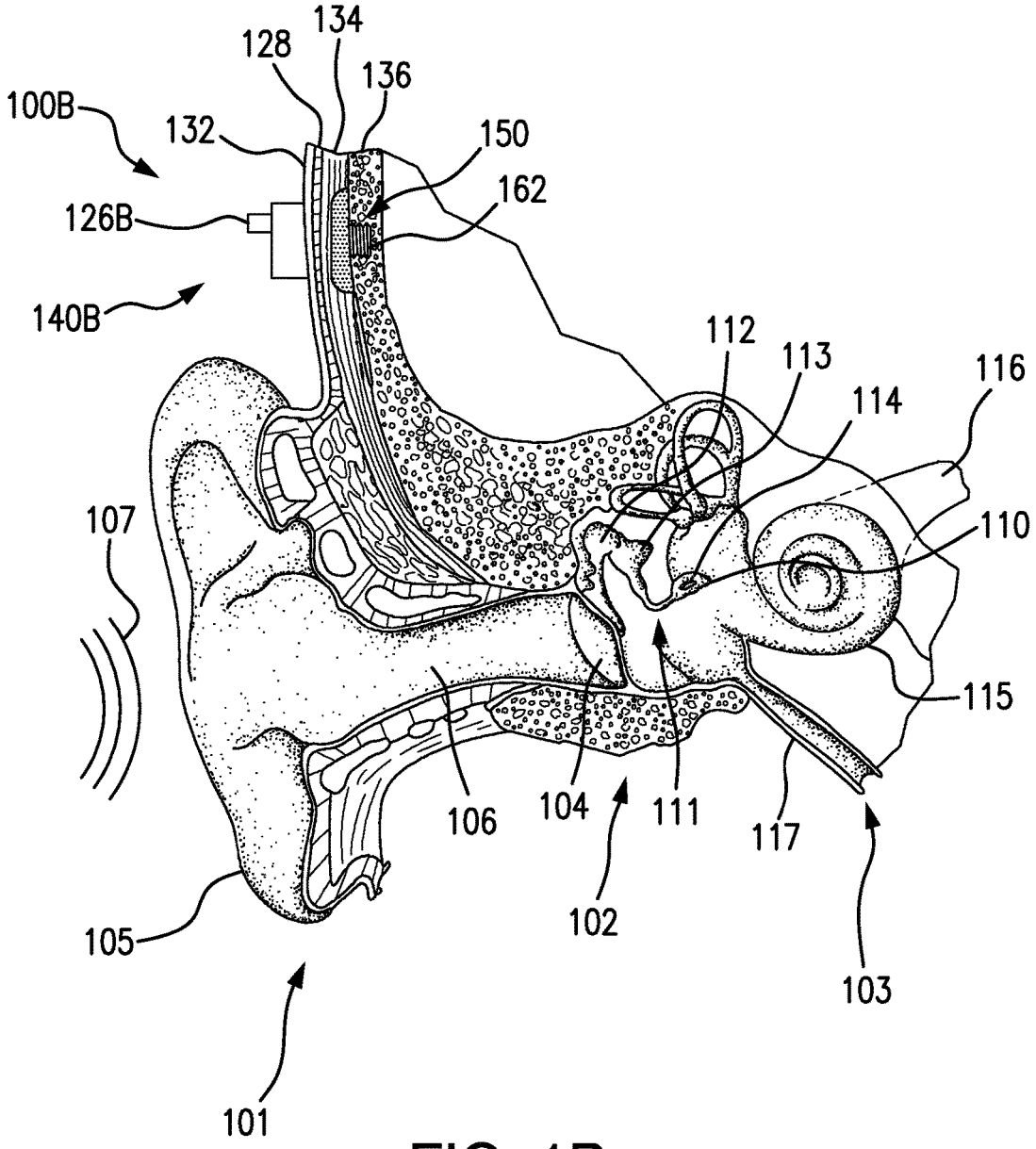
FIG. 1B is a perspective view of an alternate exemplary bone conduction device in which at least some embodiments can be implemented.

FIG. 1B is a perspective view of a transcutaneous bone conduction device 100B in which embodiments can be implemented.

FIG. 1B also illustrates the positioning of bone conduction device 100B relative to outer ear 101, middle ear 102 and inner ear 103 of a recipient of device 100. As shown, bone conduction device 100 is positioned behind outer ear 101 of the recipient. Bone conduction device 100B comprises an external component 140B and implantable component 150. The bone conduction device 100B includes a sound input element 126B to receive sound signals. As with sound input element 126A, sound input element 126B may comprise, for example, a microphone, telecoil, etc. In an exemplary embodiment, sound input element 126B may be located, for example, on or in bone conduction device 100B, on a cable or tube extending from bone conduction device 100B, etc. Alternatively, sound input element 126B may be subcutaneously implanted in the recipient, or positioned in the recipient's ear. Sound input element 126B may also be a component that receives an electronic signal indicative of sound, such as, for example, from an external audio device. For example, sound input element 126B may receive a sound signal in the form of an electrical signal from an MP3 player electronically connected to sound input element 126B.

Bone conduction device 100B comprises a sound processor (not shown), an actuator (also not shown) and/or various other operational components. In operation, sound input device 126B converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B can be a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below.

The magnetic plate of the implantable component 150 vibrates in response to vibration transmitted through the skin, mechanically and/or via a magnetic field, that are generated by an external magnetic plate.

In another arrangement of FIG. 1B, bone conduction device 100B can be an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2:
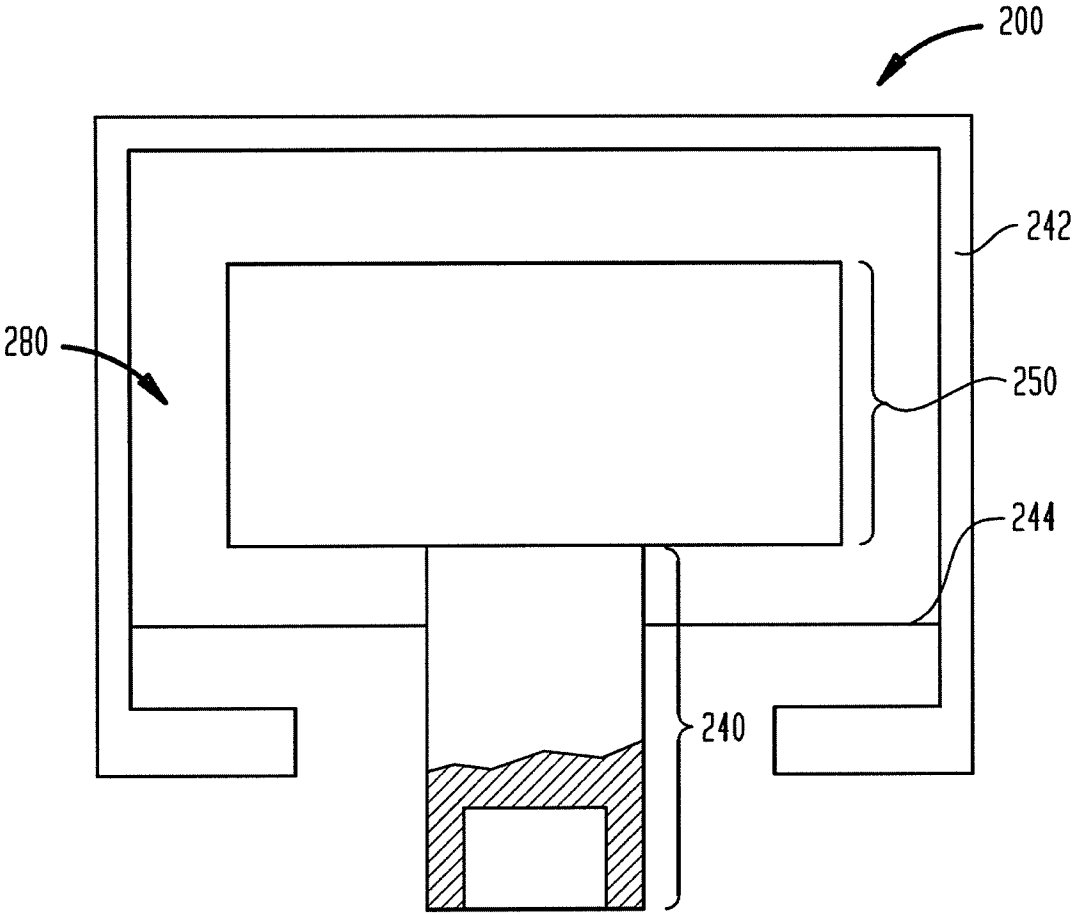
FIG. 2 is a schematic diagram conceptually illustrating a removable component of a percutaneous bone conduction device in accordance with at least some exemplary embodiments.

FIG. 2 is an embodiment of a bone conduction device 200 in accordance with an embodiment corresponding to that of FIG. 1A, illustrating use of a percutaneous bone conduction device. Bone conduction device 200, corresponding to, for example, element 100A of FIG. 1A, includes a housing 242, a vibrating actuator 250, a coupling assembly 240 that extends from housing 242 and is mechanically linked to vibrating actuator 250. Collectively, vibrating actuator 250 and coupling assembly 240 form a vibrating actuator-coupling assembly 280. Vibrating actuator-coupling assembly 280 is suspended in housing 242 by spring 244. In an exemplary embodiment, spring 244 is connected to coupling assembly 240, and vibrating actuator 250 is supported by coupling assembly 240. It is noted that while embodiments are detailed herein that utilize a spring, alternate embodiments can utilize other types of resilient elements. Accordingly, unless otherwise noted, disclosure of a spring herein also includes disclosure of any other type of resilient element that can be utilized to practice the respective embodiment and/or variations thereof.

Figure 3:
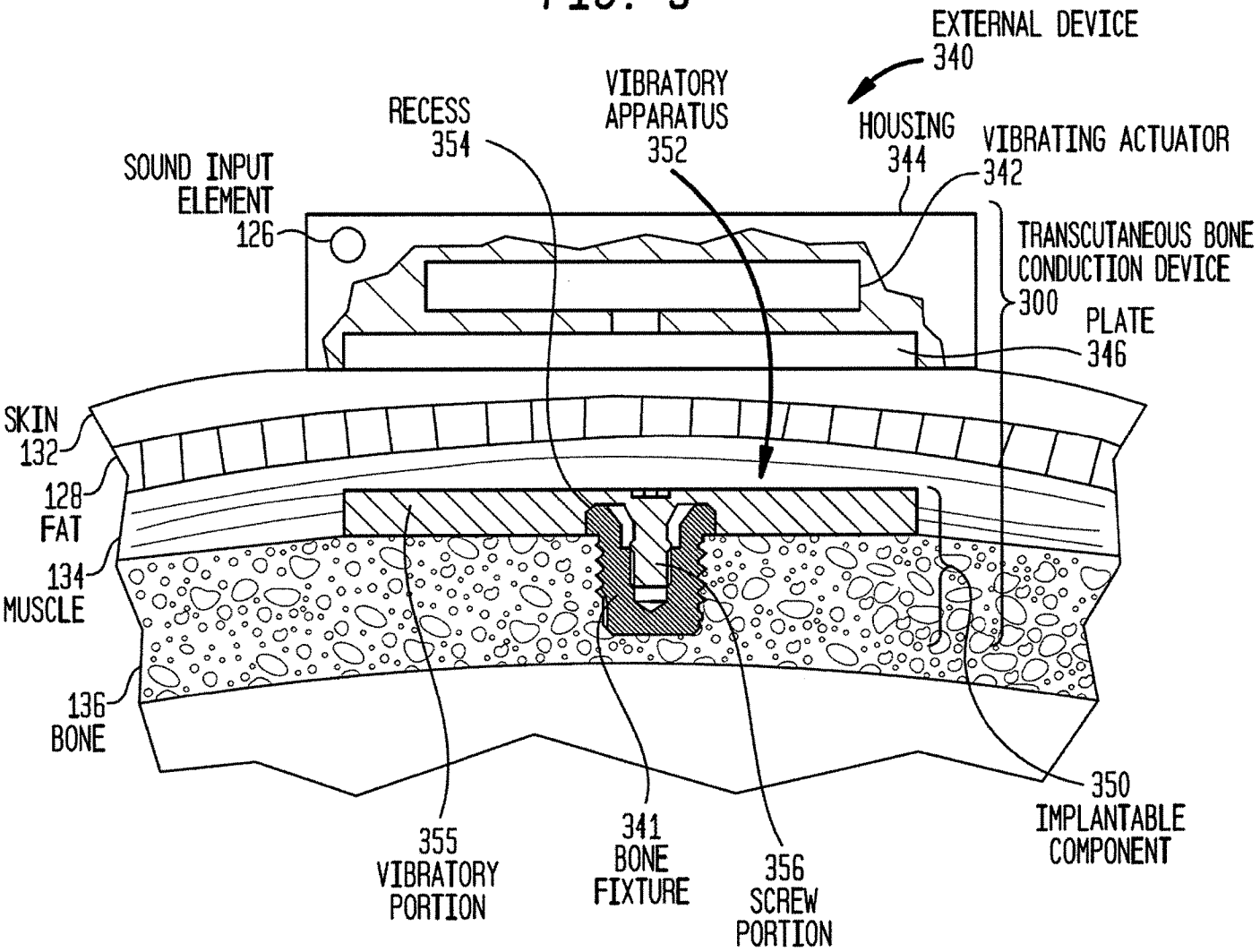
FIG. 3 is a schematic diagram conceptually illustrating a passive transcutaneous bone conduction device in accordance with at least some exemplary embodiments.

FIG. 3 depicts an exemplary embodiment of a transcutaneous bone conduction device 300 according to an embodiment that includes an external device 340 (corresponding to, for example, element 140B of FIG. 1B) and an implantable component 350 (corresponding to, for example, element 150 of FIG. 1B). The transcutaneous bone conduction device 300 of FIG. 3 is a passive transcutaneous bone conduction device in that a vibrating actuator 342 is located in the external device 340. Vibrating actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating actuator 342. The vibrating actuator 342 converts the electrical signals (processed or unprocessed) into vibrations. Because vibrating actuator 342 is mechanically coupled to plate 346, the vibrations are transferred from the vibrating actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 4:
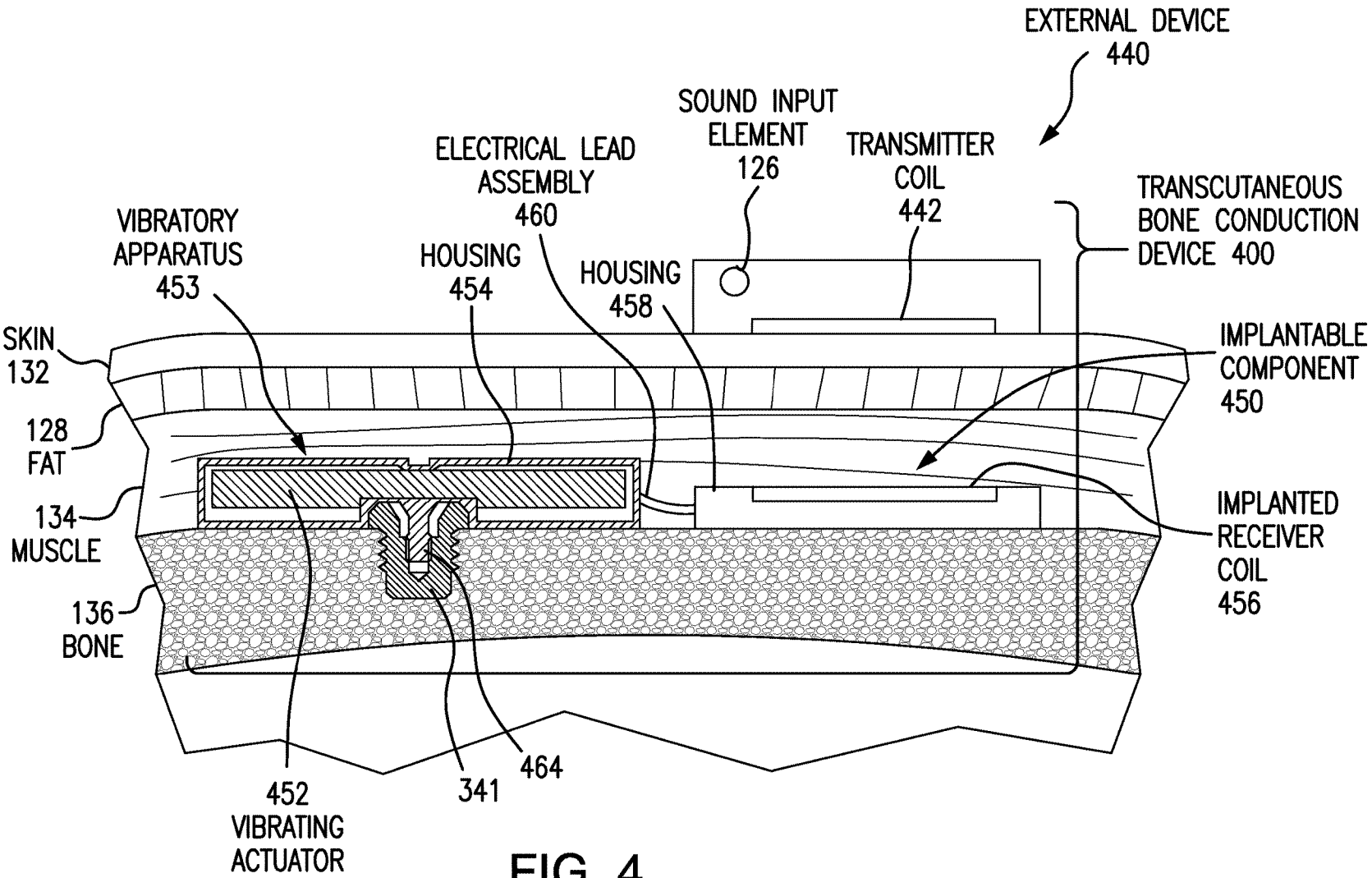
FIG. 4 is a schematic diagram conceptually illustrating an active transcutaneous bone conduction device in accordance with at least some exemplary embodiments.

FIG. 4 depicts an exemplary embodiment of a transcutaneous bone conduction device 400 according to another embodiment that includes an external device 440 (corresponding to, for example, element 140B of FIG. 1B) and an implantable component 450 (corresponding to, for example, element 150 of FIG. 1B). The transcutaneous bone conduction device 400 of FIG. 4 is an active transcutaneous bone conduction device in that the vibrating actuator 452 is located in the implantable component 450. Specifically, a vibratory element in the form of vibrating c actuator 452 is located in housing 454 of the implantable component 450. In an exemplary embodiment, much like the vibrating actuator 342 described above with respect to transcutaneous bone conduction device 300, the vibrating actuator 452 is a device that converts electrical signals into vibration.

External component 440 includes a sound input element 126 that converts sound into electrical signals. Specifically, the transcutaneous bone conduction device 400 provides these electrical signals to vibrating actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. In an exemplary embodiment, the processed signals can be encoded at a high frequency to achieve a relatively more efficient transmission. In an alternative embodiment, baseband transmission can be utilized. Components (not shown) in the housing 458, such as, for example, a signal generator or an implanted sound processor, then generate electrical signals to be delivered to vibrating actuator 452 via electrical lead assembly 460. The vibrating actuator 452 converts the electrical signals into vibrations.

The vibrating actuator 452 is mechanically coupled to the housing 454. Housing 454 and vibrating actuator 452 collectively form a vibratory apparatus 453. The housing 454 is substantially rigidly attached to bone fixture 341.

Figure 5:
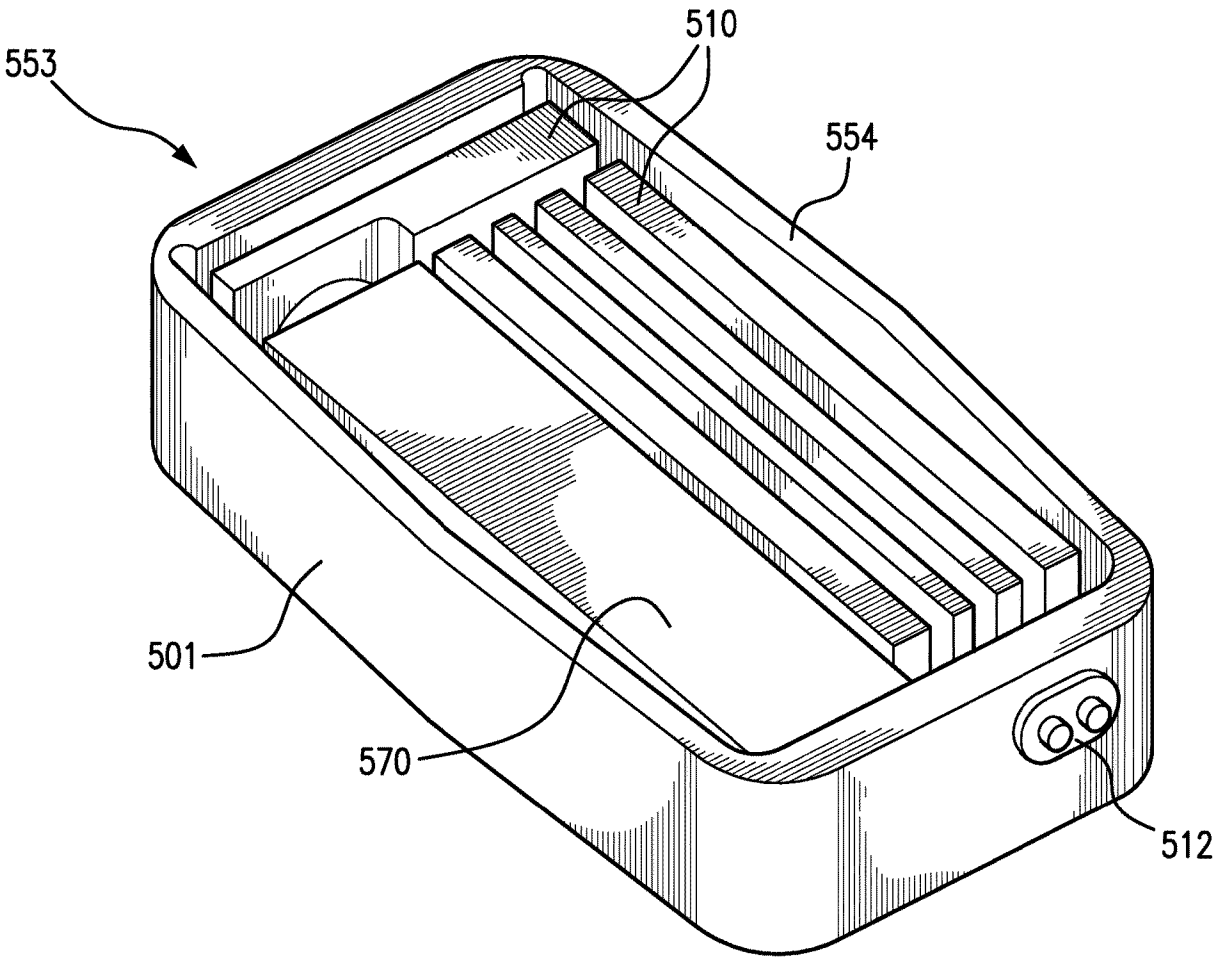
FIG. 5 is a schematic diagram of a portion of a vibratory apparatus according to an exemplary embodiment.
Figure 6:
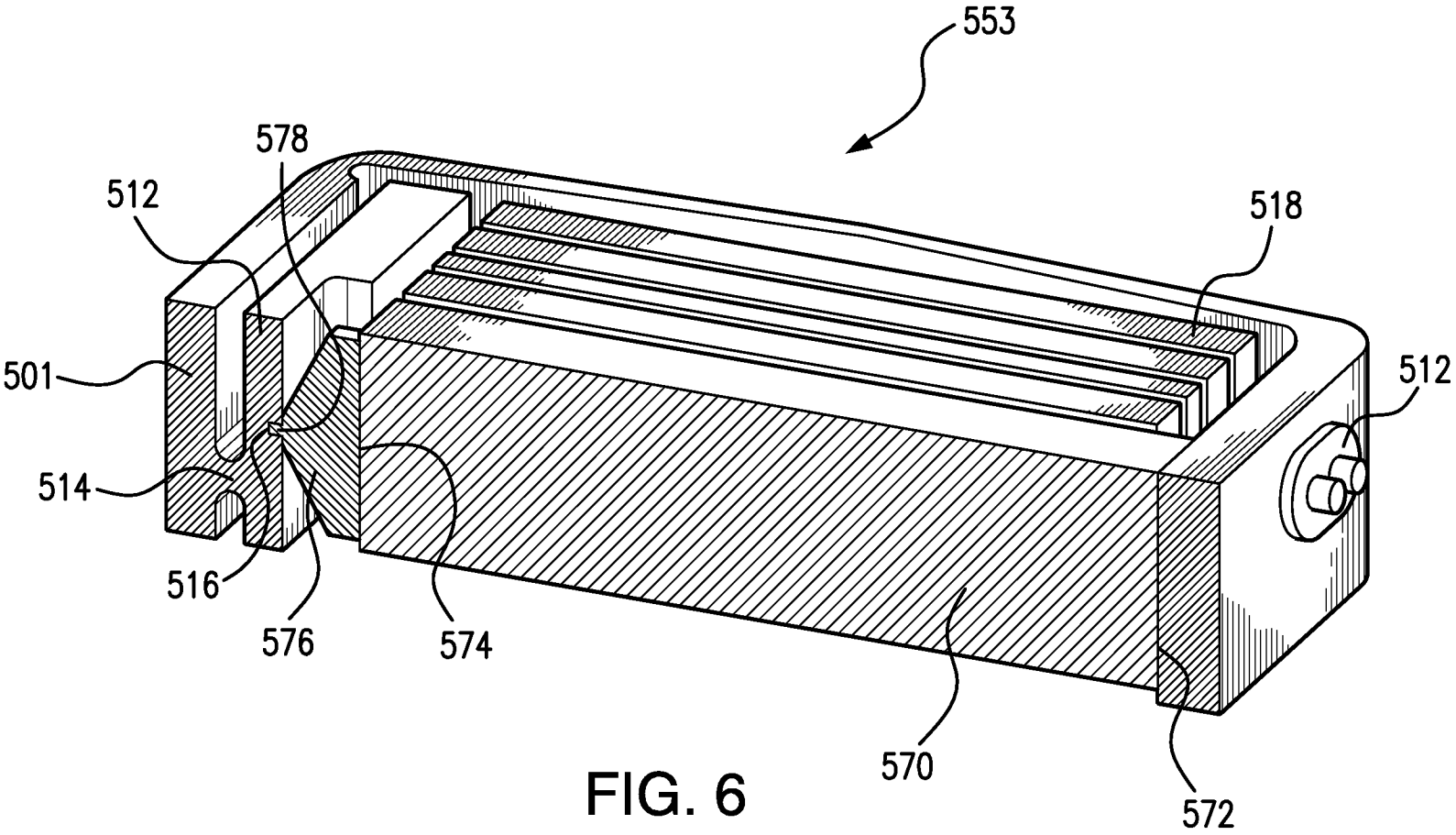
FIG. 6 is a schematic diagraph of a cross-section of the portion of a vibratory apparatus according to the exemplary embodiment of FIG. 5.

Referring now to FIG. 5, there is a vibratory apparatus 553 that can be substituted for the vibratory apparatus 453 of the transcutaneous bone conduction device 400 and/or can be utilized as a vibratory apparatus for the percutaneous bone conduction device of FIG. 4 and/or the passive transcutaneous bone conduction device of FIG. 3. More particularly, as shown in FIG. 5, the vibratory apparatus 553 includes as a bio-inert housing 554. This bio-inert housing 554 defines a hermetically sealed internal chamber in which the active components of the device are included (e.g., the vibrating actuator 552) when the top and bottom is present (not shown for clarity in FIG. 5). It is noted that in some embodiments where the vibratory apparatus 553 is not implanted (e.g., when used in a passive transcutaneous bone conduction device or a percutaneous bone conduction device), the housing is not hermetically sealed, although in other embodiments the housing is hermetically sealed even though it is not implanted. As shown, the housing 554 includes an electrical feed through 512 that can enable interconnecting to the electrical assembly 460. It is noted that FIG. 5 depicts the vibratory apparatus 453 without a top surface and a bottom surface (e.g., top lid, which is installed for example during manufacturing by laser welding the shared to the frame 501) for purposes of illustration. FIG. 6 provides a cross sectional view of the vibratory apparatus 553 of FIG. 5.

An exemplary embodiment, such as the embodiment according to that of FIGS. 5-6, vibratory apparatus 553 has a substantially rigid frame 501, which in the present embodiment defines the peripheral edge of the implant housing 554. This frame 501 is substantially rigid in comparison to the other components of the system. While being substantially rigid, it will be appreciated that some flexural movement can be applied to the frame. Exposed within the periphery of the frame 501 is a piezoelectric transducer 570 (although in other embodiments, another type of actuator, such as an electromagnetic actuator, can be utilized—any type of actuator that can enable the teachings detailed herein and/or variations thereof to be practiced can be utilized in at least some embodiments) and a transverse lever arm apparatus 510 (e.g., non-linear lever arm). The transverse lever arm apparatus 510 is operative to translate an axial movement of the piezoelectric transducer (PET) 570 from a first direction (e.g., aligned with the top or bottom surface of the housing 554) to a second direction that is substantially normal to a plane defined by the top and/or bottom surface) of the housing 554. As can be seen, the transverse lever arm apparatus 510 includes a plurality of lever arms 518. In an exemplary embodiment, the vibratory apparatus 553 in general, and the transverse lever arm apparatus 510 in particular, is configured such that the respective lever arms resonate independently from each other when the vibratory apparatus 553 is generating vibrations (such as is the case when the actuator 570 is energized, as detailed above). The ramifications of this feature are discussed in greater detail below. First however, some exemplary configurations of transverse lever arm apparatuses will be described.

As shown, a proximal end of the transverse lever arm apparatus 510 defines a footplate 512 that is interconnected to a first end of the frame by a first flexural hinge 514. In the illustrated embodiment, the transverse lever arm apparatus 510 is formed in the shape of an "L" and the piezoelectric transducer 570 applies a force to the footplate 512 of the L-shaped lever arm. The PET 570 has a first end 572 that solidly abuts against the frame 501 of the housing 554, although in other embodiments, an end cap can be positioned therebetween. A second end 574 of the piezoelectric transducer 570 supports an end cap 576 which contacts the footplate 512 of the L-shaped lever arm apparatus 510. In the embodiment depicted in FIG. 6, cap 576 tapers to a pivot point 578 which is received within a pivot recess 516 on the footplate 512. In this regard, the pivot recess point 578 and pivot 516 provide for relatively minimal contact between the PET 570 and lever arm apparatus 580 and thereby, at least in some embodiments, reduce the dampening effect of the PET 570 on the lever arm apparatus 580.

The tip of the end cap 576 and mating pivot recess 516 are located on the footplate 512 at a position above the flexural hinge 514, which interconnects the footplate 512 to the frame 501. In this regard, when the PET 570 expands upon the application or removal of an applied voltage and/or variation of the applied voltage, the end cap 576 applies a force to the end plate 512 which displaces the free ends of lever arms 518 upward in relation to a bottom surface of the housing. Likewise, upon the PET 570 contracting, the free ends of the lever arms 518 are permitted to move downward. In this regard, the movement of the PET 570 which is directed in a direction that is substantially aligned with the top surface of the housing 554, is translated into a motion that has a primary movement direction that is normal to the top surface of the housing 554. Accordingly, in an exemplary embodiment, the vibratory apparatus is configured such that the force generated by the actuator (PET 570) is applied equally to the lever arms via footplate 512. That said, in an alternate embodiment, a plurality of footplates can be utilized such that the force is not applied equally.

Some exemplary embodiments include a transverse lever arm apparatus 510 and/or other components of the vibratory apparatus 553 that are obtained by, for example, machining these components from a single piece of material (e.g. a block of titanium, corresponding to the embryonic material from which the transverse lever arm is formed). Accordingly, in an exemplary embodiment, the plurality of lever arms are part of a monolithic component.

Now with reference to FIG. 7, which depicts the transverse lever arm apparatus 510 along with a portion of frame 501, in an exemplary embodiment, the first flexural hinge 514 (and/or other hinges detailed further below) is a living hinge that is established by cutting or otherwise removing material of the embryonic component from which the transverse lever arm apparatus 510 was formed. However, in alternate embodiments, the transverse lever arm apparatus 510 is made of various components coupled to one another.

As can be seen, the transverse lever arm apparatus 510 includes a plurality of arms 518 that extend away from the footplate 512. In alternate embodiments, there is only a single arm that extends away from the footplate 512.

In addition to the flexural hinge 514 disposed between the footplate 512 and the frame 501, the long leg of the L-shaped lever arm apparatus 510 can likewise include one or more additional hinges, which will be referred to at the current time by way of example only and not by way of limitation, as resonator hinges. These one or more additional hinges 522 are relatively compliant locations along the length of the lever arm apparatus that allow for generating a utilitarian resonance of the free end of the levers 518. Though shown as including a single additional hinge 522 (only one second hinge), in other embodiments, two or more additional hinges (e.g., two or more additional resonator hinges) or other compliant portions can be incorporated into the lever arm apparatus to tailor a desired frequency response(s), as will be further detailed below. In some embodiments, the manner in which the second hinge(s) 522 is formed is similar to and/or the same as that utilized to form the first hinge 514. In some embodiments, the second hinge(s) 522 is a living hinge.

In an exemplary embodiment, there is a bone conduction device that includes a transverse lever arm apparatus having specific geometries that are configured to influence the performance of the bone conduction device in which it is included. By way of example only and not by way of limitation, such influence can include influencing the location of a resonance peak of the bone conduction device and/or smoothing out and/or broadening that peak. Exemplary devices and systems of such an embodiment, as well as exemplary methods of implementing such an embodiment, will now be described. It is noted that any method detailed herein and/or variation thereof pertaining to the manufacture and/or fabrication of a component of a bone conduction device corresponds to a disclosure of a device or system including the resulting component, and visa-versa.

Figure 7:
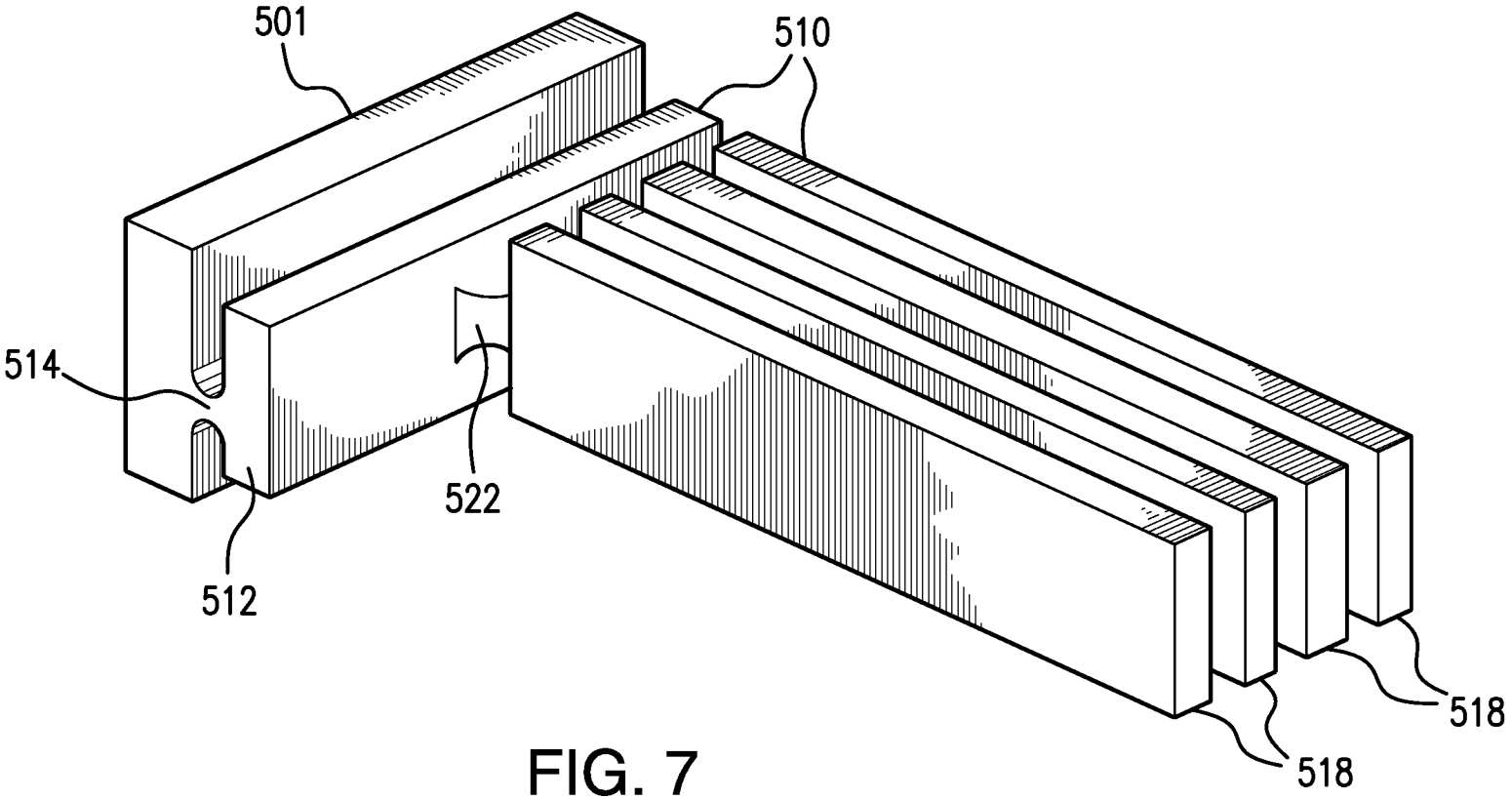
FIG. 7 is a schematic diagram of a transverse lever arm apparatus according to an exemplary embodiment.
Figure 8:
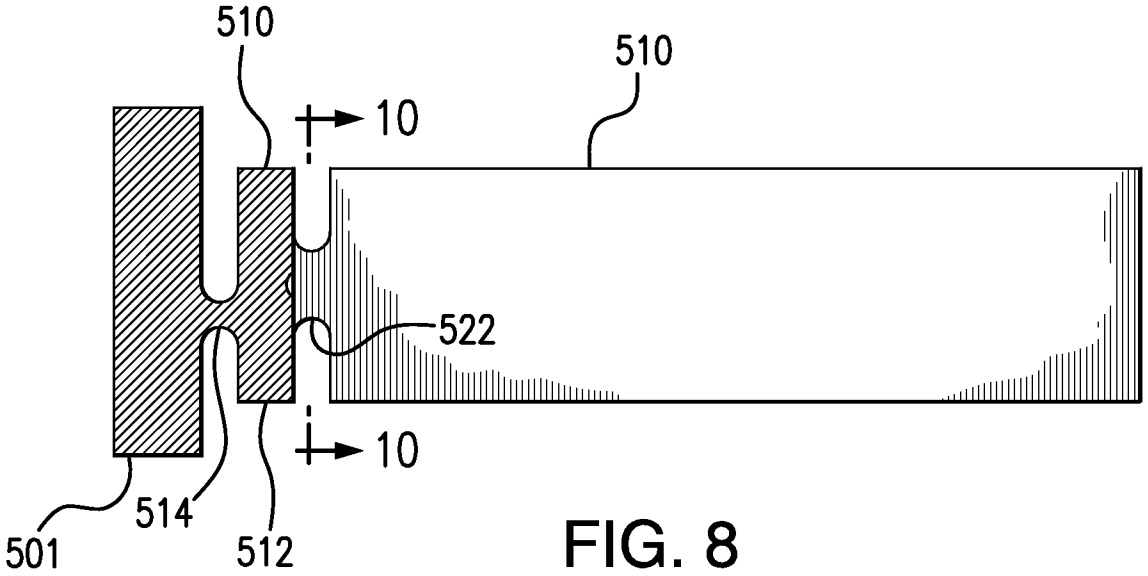
FIG. 8 is a side view of the components depicted in FIG. 7.
Figure 9:
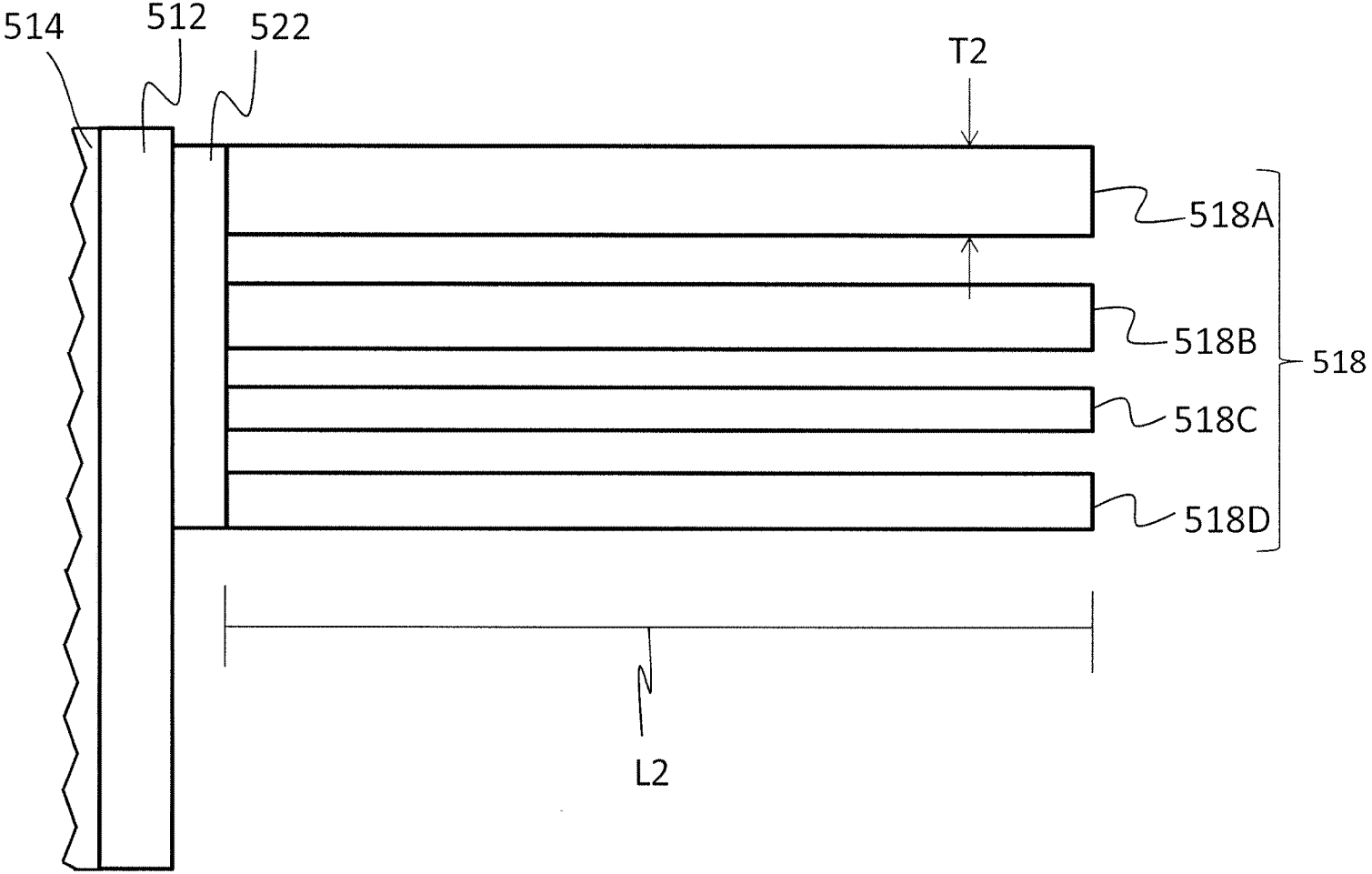
FIG. 9 is a top view of the components depicted in fig seven FIG. 7.
Figure 10:
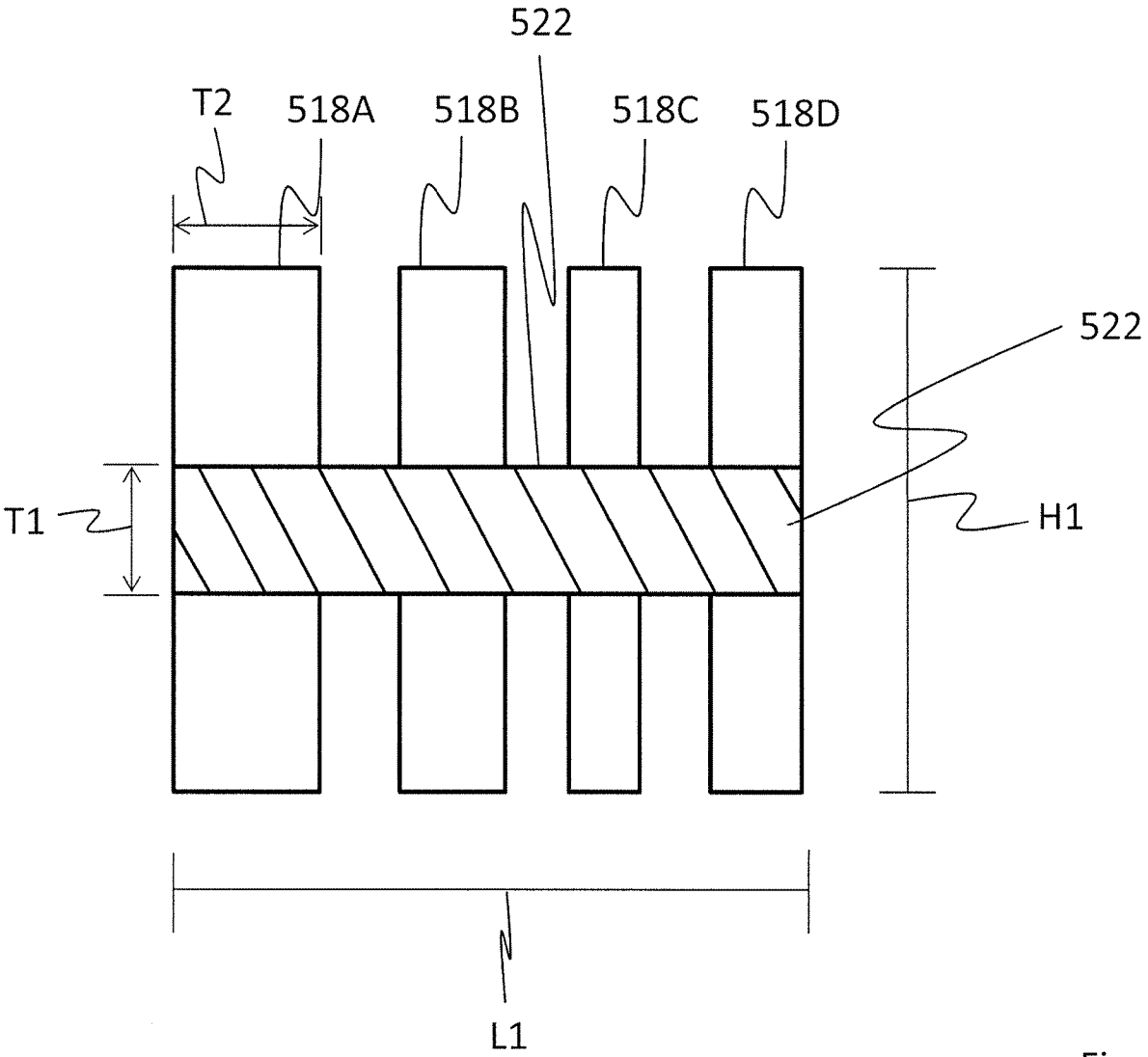
FIG. 10 is a cross-sectional view of components depicted in FIG. 8.

FIG. 8 depicts a side-view of some of the components illustrated in FIG. 7. More specifically, FIG. 8 depicts a cross-section of frame 501, hinge 514, and footplate 512. FIG. 8 also depicts the transverse lever arm apparatus 510 with second hinge 522. Consistent with FIG. 7, not depicted is the piezoelectric stack 570 and end cap 576 and other components for purposes of clarity. FIG. 9 depicts a top-view of some of the components depicted in FIG. 7, clearly depicting that 518A-D are separated from each other. FIG. 10 depicts a cross-section through the second hinge 522 of FIG. 8, also showing the lateral features of the arms 518A-D.

Some of the specific geometries of the transverse lever arm apparatus 510 in general, and the arms 518 and hinge 522 in particular will now be detailed by way of an exemplary embodiment.

FIG. 10, which again which depicts a cross-section through the second hinge 522 of FIG. 8, depicts dimension T1 corresponding to a thickness of the narrowest portion of the hinge 522 and dimension L1 corresponding to a length of the narrowest portion of the hinge. Accordingly, the hinge 522 has an aspect ratio according to the equation $$\text{Aspect Ratio}=L1/T1$$

By varying the ratio of L1 to T1, the value of the aspect ratio will change. That is, as L1 becomes larger and/or as T1 becomes smaller, the aspect ratio will correspond to a relatively higher value. Conversely as L1 become smaller and/or as T1 becomes larger the aspect ratio will correspond to a relatively lower value. In an exemplary embodiment, as the relative aspect ratio increases, the relative location of the resonant frequency decreases and conversely, as the relative aspect ratio decreases, the relative location of the resonant frequency increases.

Still with reference to FIG. 10, it can be seen that the arms 518A-D can have different thicknesses T2 and 10 have the same height H1. Alternatively, as will be detail below, the thicknesses can be the same in other embodiments, and/or the heights can be different in other embodiments. Now with reference back to FIG. 9, as can be seen, the lengths L2 of the arms 518A-D can be the same for each arm. Alternatively, as will be detailed below, the lengths L2 can be different in other embodiments.

In an exemplary embodiment, one or more or all of the lever arms is/are flexibly anisotropic. Conversely, in an alternate exempt exemplary embodiment, one or more or all of the lever arms is/are flexibly isotropic.

Figure 11:
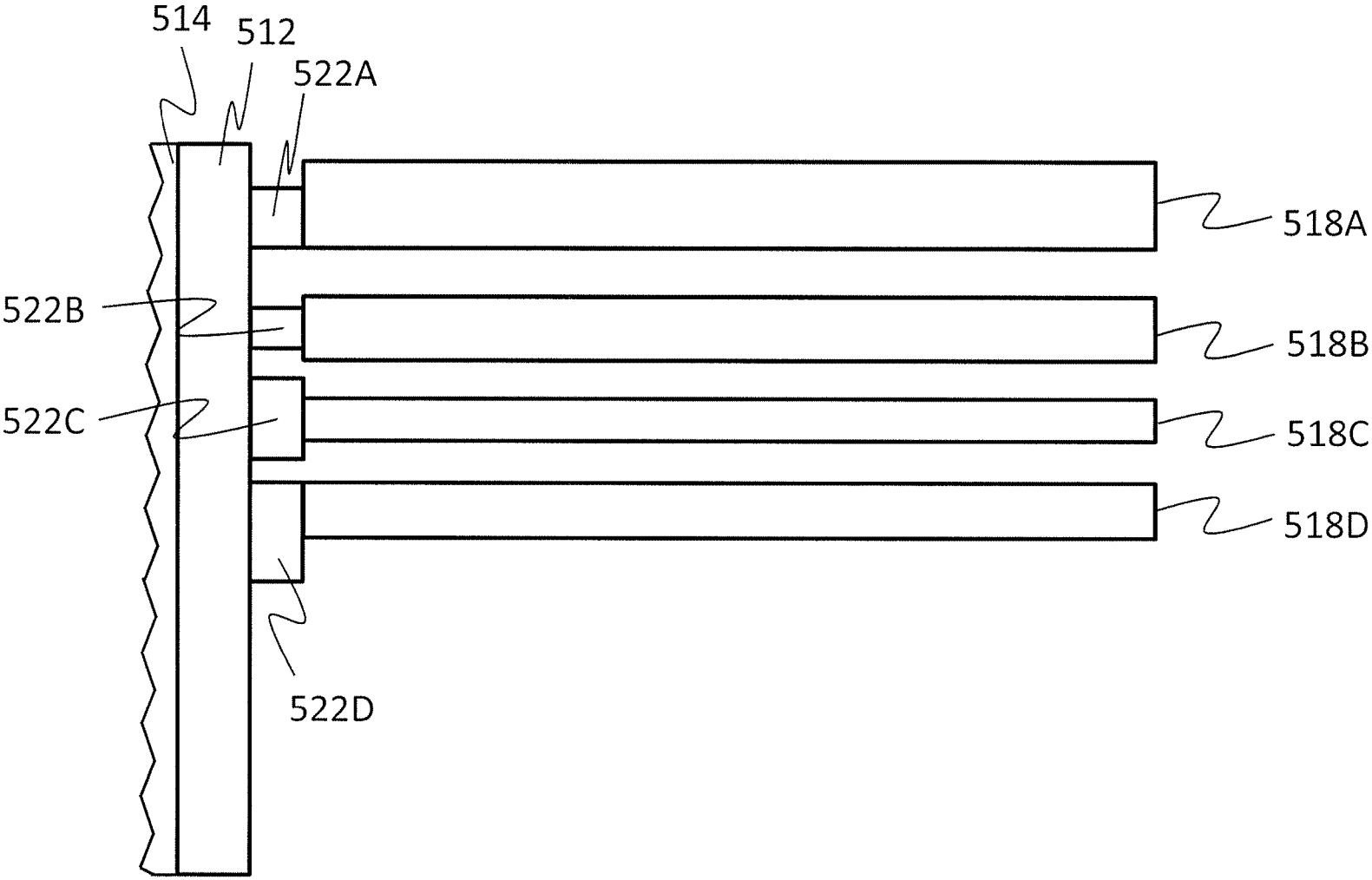
FIG. 11 is a top view of an alternate embodiment of a transverse lever arm apparatus.
Figure 12:
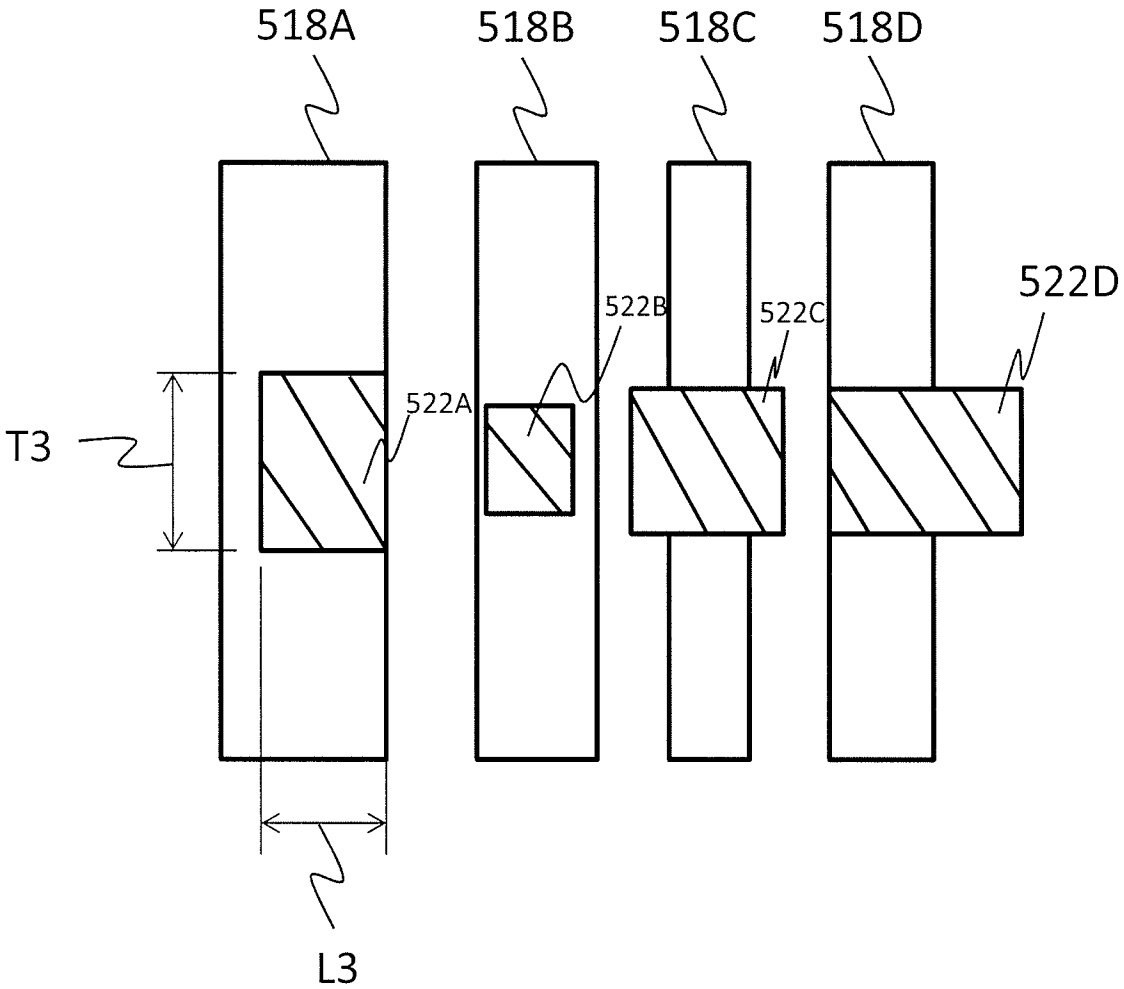
FIG. 12 is a cross-sectional view of components depicted in FIG. 11.

It is noted that in an alternate embodiment, now with reference to FIGS. 11 and 12, instead of a single hinge element 522 that is common to all of the arms 518, each arm has an individual hinge element (although in an alternate embodiment, two or more arms can share an individual hinge element, and/or a given arm can have two or more hinge elements). In this regard, FIG. 11 depicts an alternate embodiment corresponding to the view of FIG. 9, where each arm 518A-D has a respective hinge element 522A-D. FIG. 12 depicts a cross-sectional view through the hinge elements 522A-D, corresponding to the view of FIG. 10. Accordingly, each respective hinge element 522A-D has its own respective aspect ratio determined by the equation $$\text{Aspect Ratio}=L3/T3$$

As can be seen from the figures, the thickness T3 and/or the length L3 of the respective hinge elements can vary from arm to arm. In an exemplary embodiment, the thickness T3 and/or the length L3 can "control" (or, more accurately, impact) the vibrational performance of each individual arm. More specifically, in an exemplary embodiment, all other things being equal, the greater the thickness T3 for a given length L3, and/or the greater the length L3 for a given thickness T3, the higher the resonant frequency of the given arm. Conversely, in an exemplary embodiment, all other things being equal, the lower the thickness T3 for a given length L3, and/or the lower the length L3 for a given thickness T3, the lower the resonant frequency of the given arm. Any thickness and/or length dimension that can enable the teachings detailed herein and/or variations thereof can be utilized in at least some embodiments. It is further noted that the concept of having different aspect ratios for different arms can be applied, at least in part, in embodiments utilizing the single hinge (e.g., the embodiments of FIGS. 9 and 10). For example, the hinge 522 can have a thickness T1 that varies with location along the dimension L1.

FIG. 12 depicts the hinge elements 522A-D as variously being on center and off-center relative to the vertical centerline of each respective arm. It is noted that in some embodiments, the hinge elements are all on center with respect to the vertical centerline, while in other embodiments, the hinges are all off center with respect to the vertical centerline. Conversely, all of the hinge elements 522A-D are depicted as being on center with the horizontal centerline of the arms. However, in an alternate embodiment, one or more or all of the hinge elements 522A-D R off-center with the horizontal centerline of the arms. Any spatial relationship of the hinge elements 522A-D that can enable the teachings detailed herein and/or variations thereof to be practiced can utilize in at least some embodiments.

It is further noted that the concept of having nonuniform centering of the hinge(s) can be applied, at least in part, in embodiments utilizing the single hinge (e.g., the embodiments of FIGS. 9 and 10). For example, the hinge 522 can have a centerline that varies with location along the dimension L1.

It is noted that while FIGS. 11 and 12 depict hinge elements having different thickness and different lengths, in an alternate embodiment, the thicknesses and/or lengths can be the same. Any geometry that can enable the teachings detailed herein and/or variations thereof to be practiced can be utilized in at least some embodiments.

Figure 13:
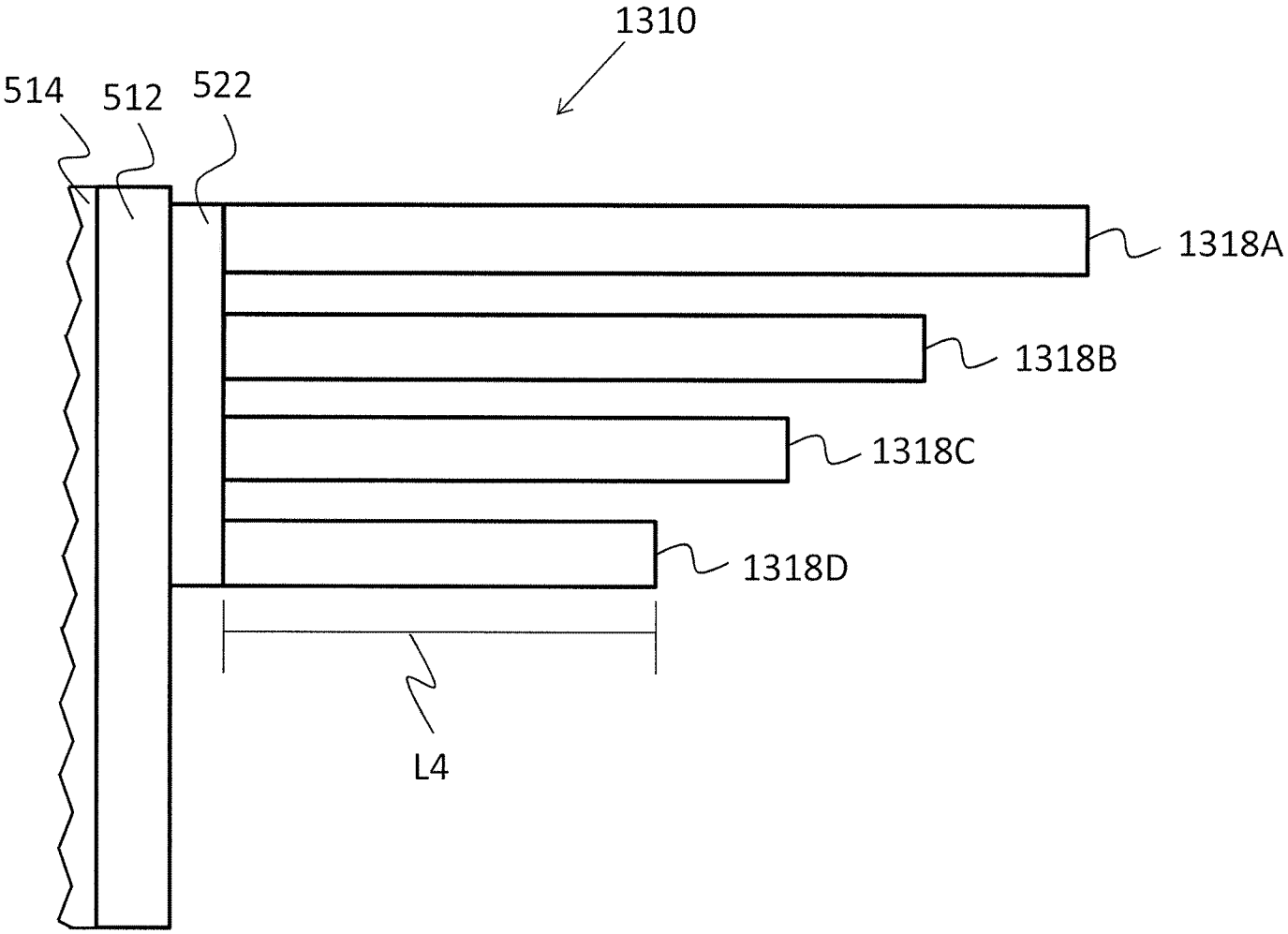
FIG. 13 is a top view of another alternate embodiment of a transverse lever arm apparatus.
Figure 14:
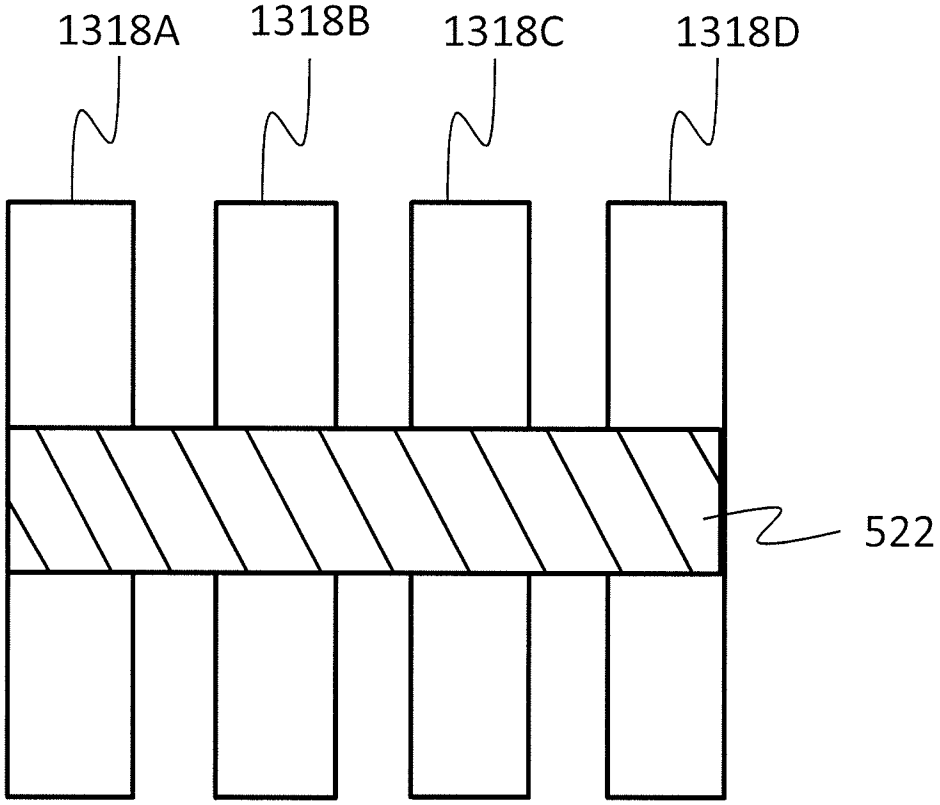
FIG. 14 is a cross-sectional view of components depicted in FIG. 13.

FIGS. 13 and 14 depict an alternate embodiment (with the views of FIGS. 13 and 14 respectively corresponding to those of FIGS. 9 and 10), it is noted that in an alternate embodiment, the arms of the transverse lever arm apparatus have different lengths. More particularly, depicted in these FIGs. is a transverse lever arm apparatus 1310 having arms 1318A-D. As can be seen, each arm has a different length L4. In an exemplary embodiment, the length L4 can "control" (or, more accurately, impact) the vibrational performance of each individual arm. More specifically, in an exemplary embodiment, all other things being equal (e.g., material properties (e.g., density) and thickness and widths of each arm being the same, such that the center of gravity of each arm varies with length and no other property), the greater the length L4, the lower the resonant frequency of the given arm. Conversely, in an exemplary embodiment, all things being equal, the lower the length L4 higher the resonant frequency of the given arm. Any length dimension L4 that can enable the teachings detailed herein and/or variations thereof can be utilized in at least some embodiments.

Figure 15:
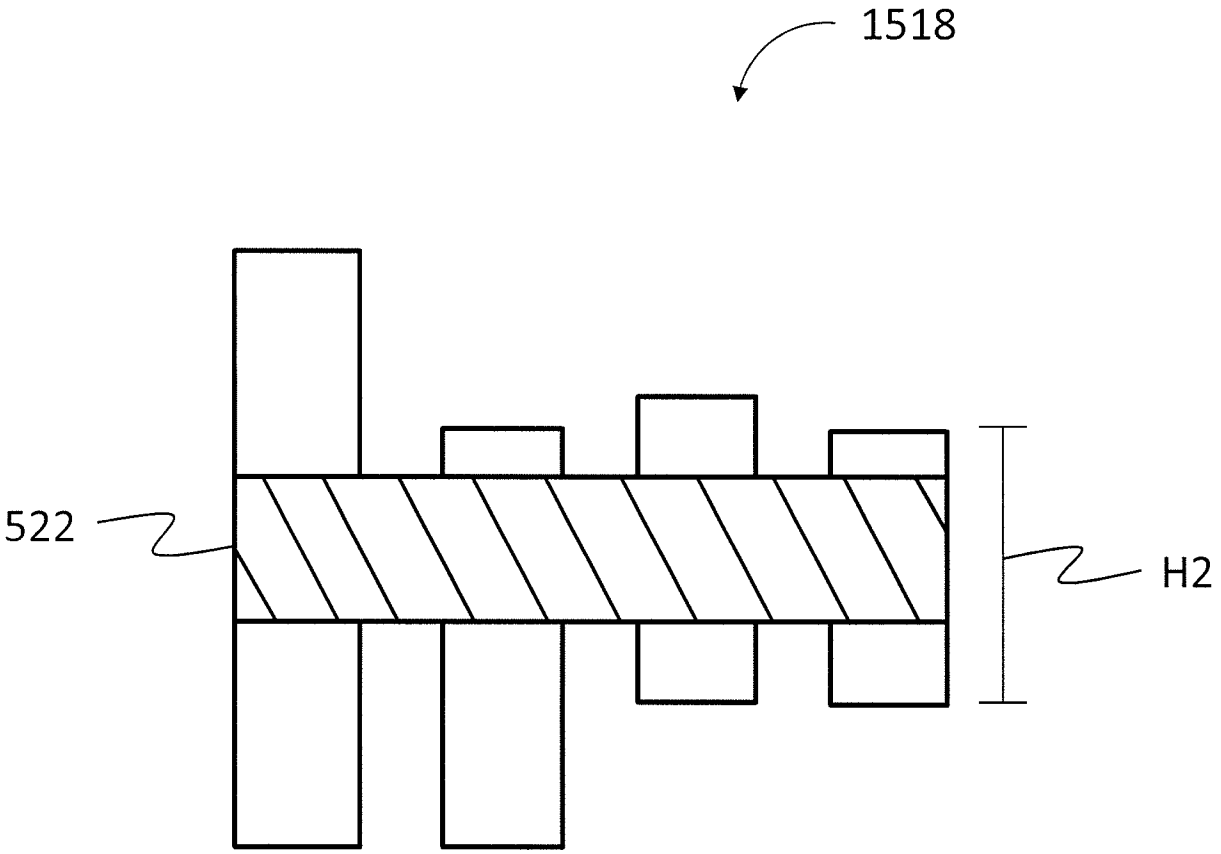
FIG. 15 is a cross-sectional view of another exemplary embodiment of a transverse lever arm apparatus.

FIG. 15 depicts an alternate embodiment of a transverse lever arm apparatus 1518 where the height H2 of the arms varies from one arm to another, as can be seen. This can have the effect of varying the equivalent mass located at the center of gravity of the each arm, because, if all other things are equal, the mass of each arm will be different and be "determined" based on the height H2 of each arm. In an exemplary embodiment, this can control/impact the vibrational performance of each arm.

As can be seen from FIG. 15, not all of the arms are centered in the vertical direction relative to the hinge 522. In an exemplary embodiment, all arms are centered irrespective of the height H2, while in an alternative exemplary embodiment, none of the arms are centered. Again any configuration and arrangement of the arms that can enable the teachings detailed herein and/or variations thereof to be practiced can utilize in at least some embodiments.

Figure 16:
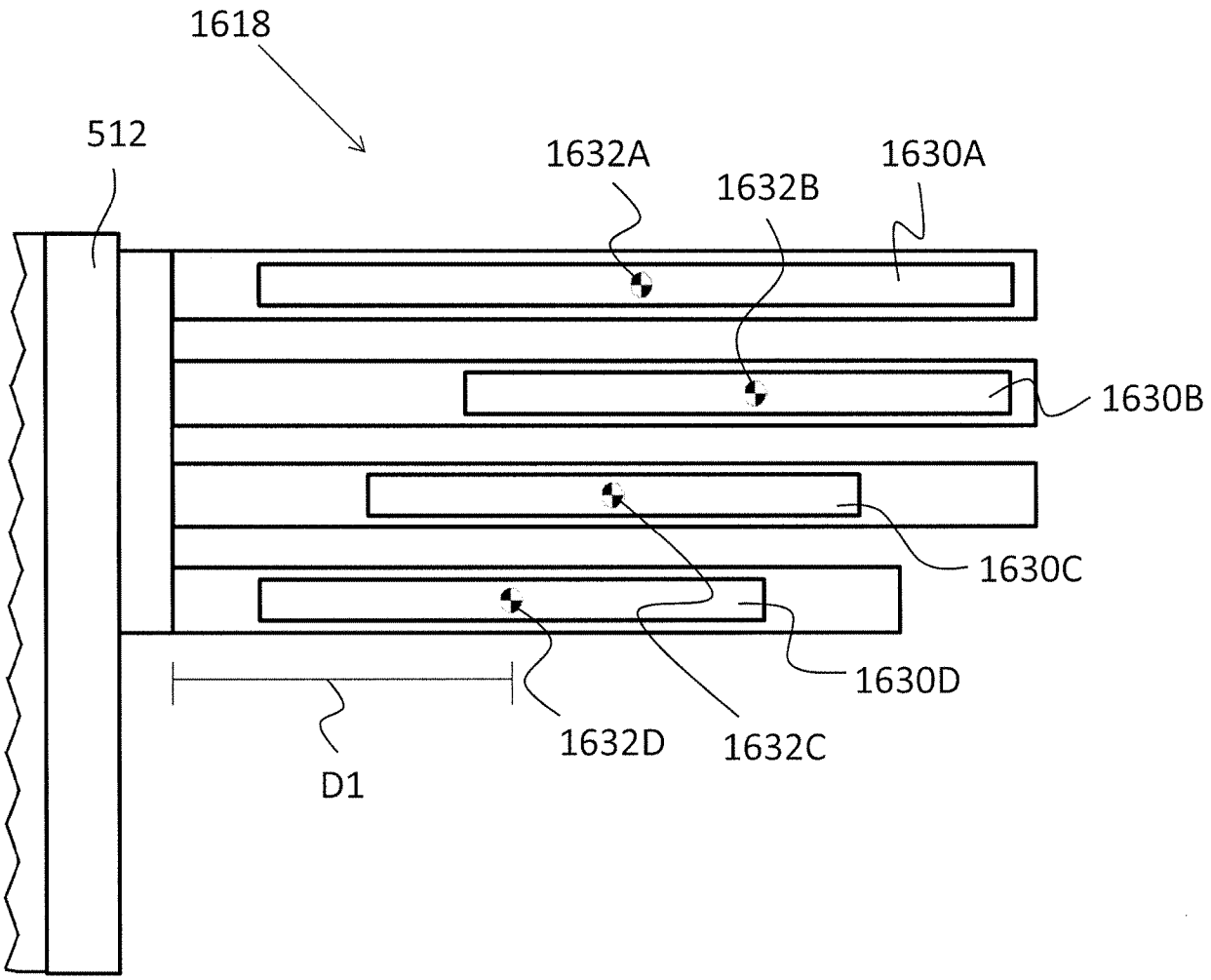
FIG. 16 is a top view of another alternate embodiment of a transverse lever arm apparatus.

FIG. 16 depicts an alternate embodiment of a transverse lever arm apparatus 1618, in which separate mass elements 1630A-D are respectively included in the arms of the apparatus. More particularly, an exemplary embodiment, these mass elements are made of a material that is generally more dense than the material from which the other components of the transverse lever arm apparatus (e.g. the arms, the footplate, the hinge(s), etc.) are made. By way of example only and not by way of limitation, in some embodiments, the other components are made of titanium, and the mass elements are made of iron and/or tungsten and/or iridium, etc., The mass elements are embedded or otherwise attached to the titanium material of the arms. As can be seen from FIG. 16, the location and/or dimensions of the mass element can be different with respect to each arm. The dimensions of the mass element can vary so as to increase and/or decrease the total mass added to each arm. Alternatively and/or in addition to this, the location of the mass elements can vary (e.g., along the length of the arms, etc.).

The amounts of mass element and/or the location of the mass element can control/impact the center of gravity and the equivalent mass of each arm. Accordingly, by varying the location and/or amounts of the mass element, these features can the changed relative to that which would be the case for a given arm without the mass elements. More particularly, in an exemplary embodiment, for a given arm length, the center of gravity of given arms can be different. Specifically, FIG. 16 depicts the center of gravity of the arms 1632A-D respectively at different distances D1. As can be seen from the figures, the respective distances D1 for the respective centers of gravity do not necessarily increase in a consistent fashion with location along the footplate 512. For example, starting from the bottom arm and moving upward, the distance D1 increases for the first three arms and then decreases for the last arm. This is the case even though the last arm has more mass element than any of the other arms (in its entirety, it is more "massive" than any other arm). Thus in an exemplary embodiment, an arm can have a greater mass/equivalent mass relative to another arm but also have a center of gravity having a distance D1 that is less than that of the other arm, this even though the overall length of each arm is the same.

It is noted that the embodiments of the FIGs. depict the utilization of four separate arms. In alternative embodiments, fewer arms or more arms can be utilized. By way of example and not by way of limitation, 2, 3, 4, 5, 6, 7, 8, 9, 10, 11, 12, 13, 14, 15, 16, 16, 18, 19, 20, 21, 22, 23, 24, 25 or more arms can be utilized. Any number of arms that can enable the teachings detailed herein and or variations thereof can be utilized in at least some embodiments.

View of the above, in an exemplary embodiment, there is a device such as a vibratory apparatus of a bone conduction device (whether it be a percutaneous bone conduction device, active transcutaneous bone conduction device or passive transcutaneous bone conduction device, or any other type of bone conduction device, etc.), having an actuator (e.g., a piezoelectric actuator such as actuator 570 detailed above) configured to generate vibrations upon actuation of the actuator. The vibratory apparatus further includes a plurality of lever arms (e.g., arms 518A-D). The vibratory apparatus is configured such that at least a respective portion of respective lever arms of the plurality of lever arms move about at least one of a single hinge (e.g., 522) or a respective hinge (e.g., respective hinges 522A-D) when the vibratory apparatus is generating vibrations (such as that which would be the case when a sound capture device of the bone conduction device captures sound, and a sound processor outputs a signal based on the captured sound, where the actuator is actuated based on the signals, thereby evoking a hearing percept based on the vibrations that emanate from the vibratory apparatus).

In an embodiment such as that corresponding to the embodiment of FIGS. 9 and 10, the respective portions of respective lever arms of the plurality of lever arms move about a single hinge (e.g., hinge 522) when the vibratory apparatus is generating vibrations. Conversely, in an embodiment such as that corresponding to the embodiment of FIGS. 11 and 12, the respective portions of respective lever arms of the plurality of lever arms move about respective hinges (e.g., 522A-D) when the vibratory apparatus is generating vibrations. In one exemplary embodiment corresponding to this latter embodiment, arms 518A and 518B have respective portions that move about hinges 518A and 518B as shown in FIGS. 11 and 12, while the remaining arms share the same hinge.

Still further, in an exemplary embodiment, there is a vibratory apparatus as detailed herein and/or variations thereof that includes a transverse lever arm apparatus that includes two or more lever arms, where at least one of the lever arms has a static moment of inertia about a respective hinge that is effectively different from that of another of the lever arms. An exemplary embodiments of this can be seen in FIGS. 13 and 16, where the difference in location of the center of gravity results in the different static moments of inertia. In an alternate exemplary embodiment, there is a vibratory apparatus as detailed herein and or variations thereof that includes a transverse lever arm apparatus that includes two or more lever arms, where at least one of the lever arms has a mass that is different than that of another arm. In an exemplary embodiment of such embodiments, the center of gravity of the one lever arm can be the same as that of the other lever arm. In an alternate embodiment, the center of gravity for one of these arms can be different than that of another of the arms.

Figure 17:
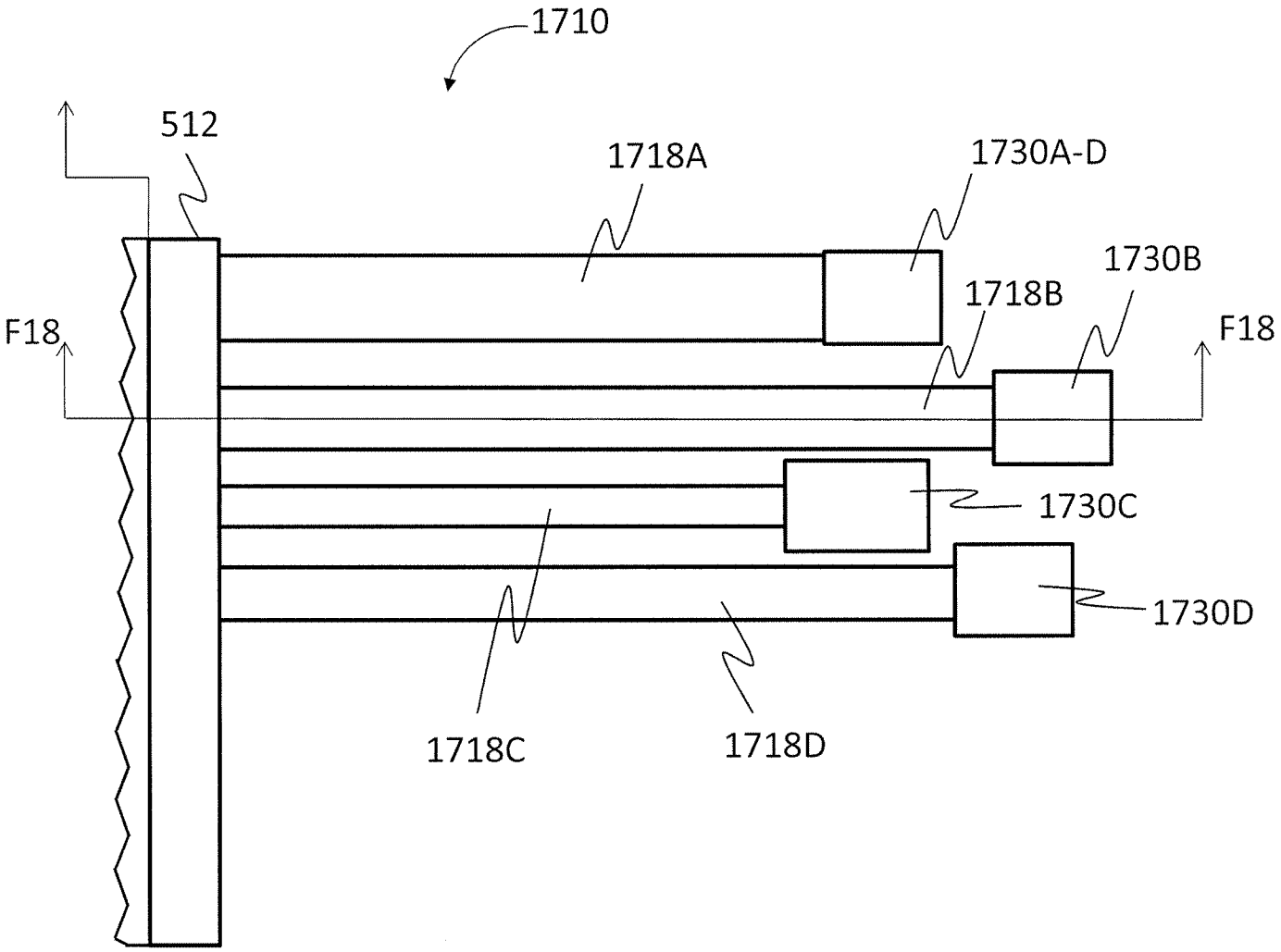
FIG. 17 is a top view of another alternate embodiment of a transverse lever arm apparatus.
Figure 18:
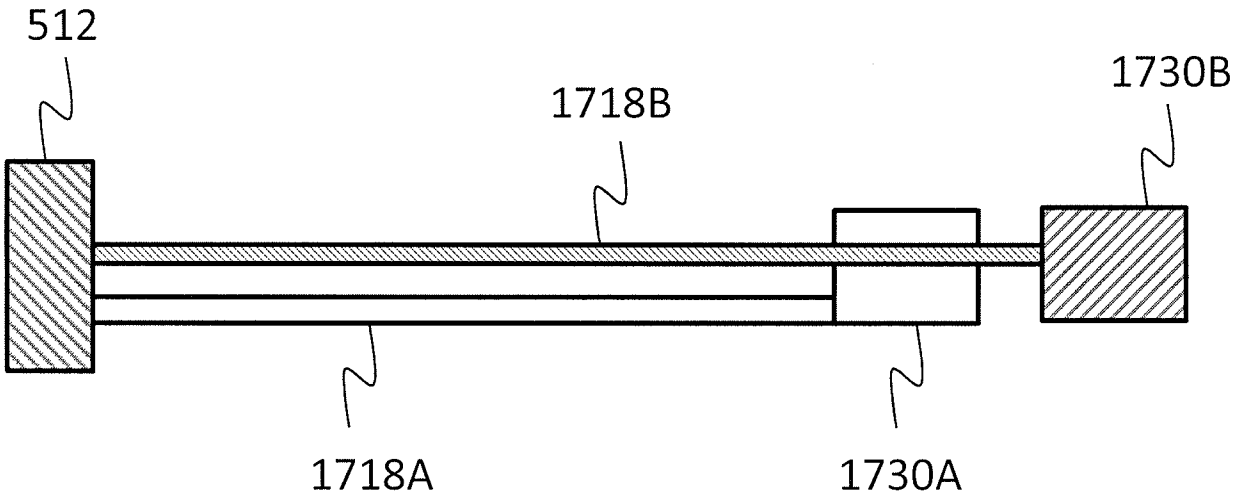
FIG. 18 is a cross-sectional view of components depicted in FIG. 17.

FIG. 17 depicts an alternate embodiment of a transverse lever arm apparatus 1710 according to an exemplary embodiment. In the embodiment of FIG. 17, instead of a lever arm and hinge arrangement, the hinges are eliminated and the lever arms corresponding to leaf springs 1718A-D to which are respectively attached mass elements 1730A-D. FIG. 18 depicts a cross-sectional view through leaf spring 1718 B, mass element 1730B and footplate 512. From these figures, it can be seen that the lengths, widths and or thicknesses of the leaf springs can vary from one leaf spring to the other. Also from these figures, it can be seen that the size and/or the locations of the mass elements can vary from one leaf spring to the other. In some embodiments, the mass of the mass elements can be different from one leaf spring to the other. Also as can be seen from these figures, the location to which the leaf springs attached to the footplate and or the mass elements can be different from one leaf spring to the other. Any configuration utilizing leaf springs that can enable the teachings detailed herein and or variations thereof to be practiced can be utilized in at least some embodiments.

In an alternative embodiment, a combination of leaf springs and lever arms-hinge arraignments are utilized in a given vibratory apparatus. In some embodiments, this entails utilizing some lever arms/hinges, and some leaf springs. For example, with respect to the embodiment of FIG. 13, this can entail replacing, for example, lever arms 1318A and/or lever arm 1318B (or any other one or more arms) and their respective hinges with leaf spring/mass element combinations. Alternatively, and/or in addition to this, in an alternate embodiment, leaf springs to which mass elements are attached can be mounted on lever arms.

Figure 19:
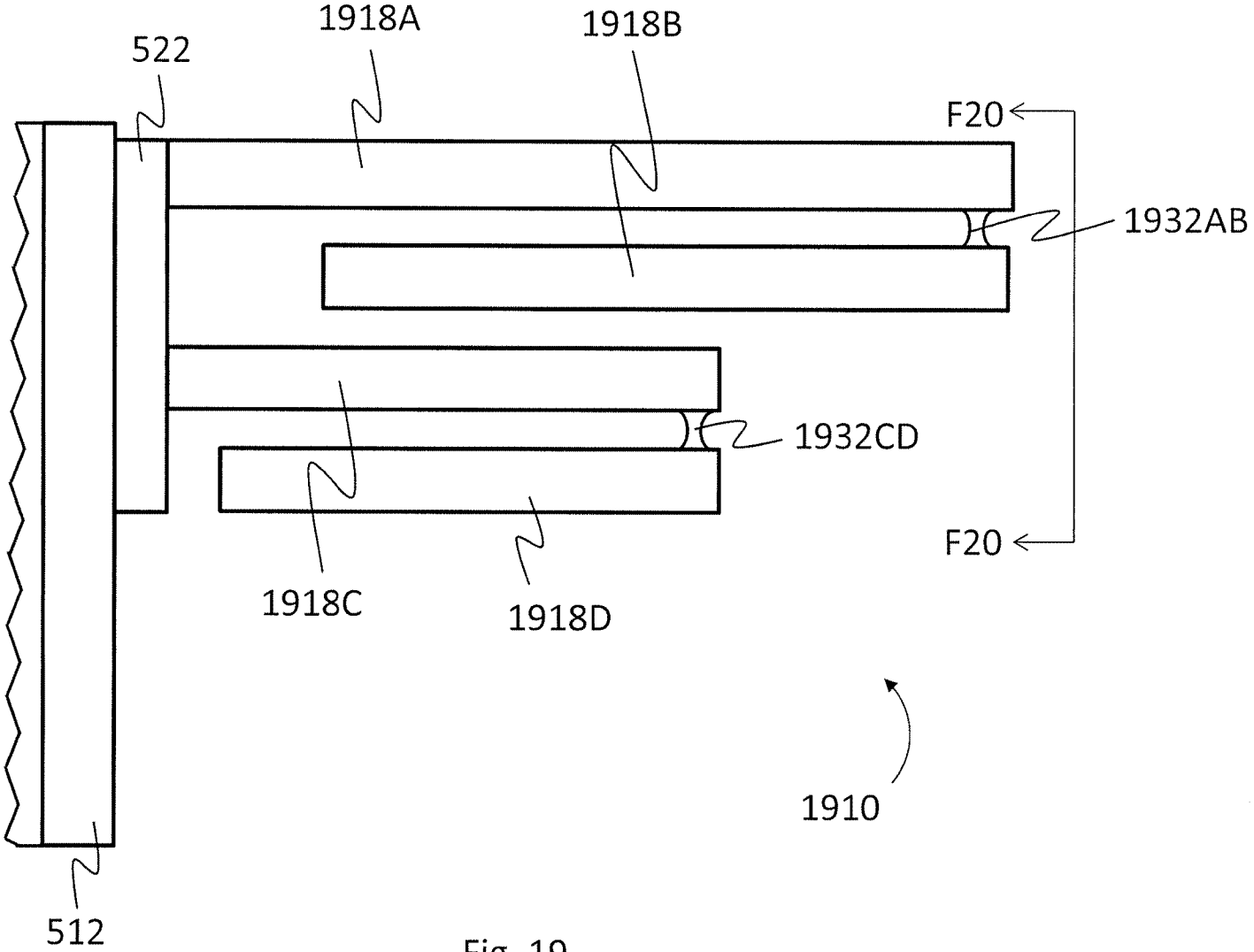
FIG. 19 is a top view of another alternate embodiment of a transverse lever arm apparatus.
Figure 20:
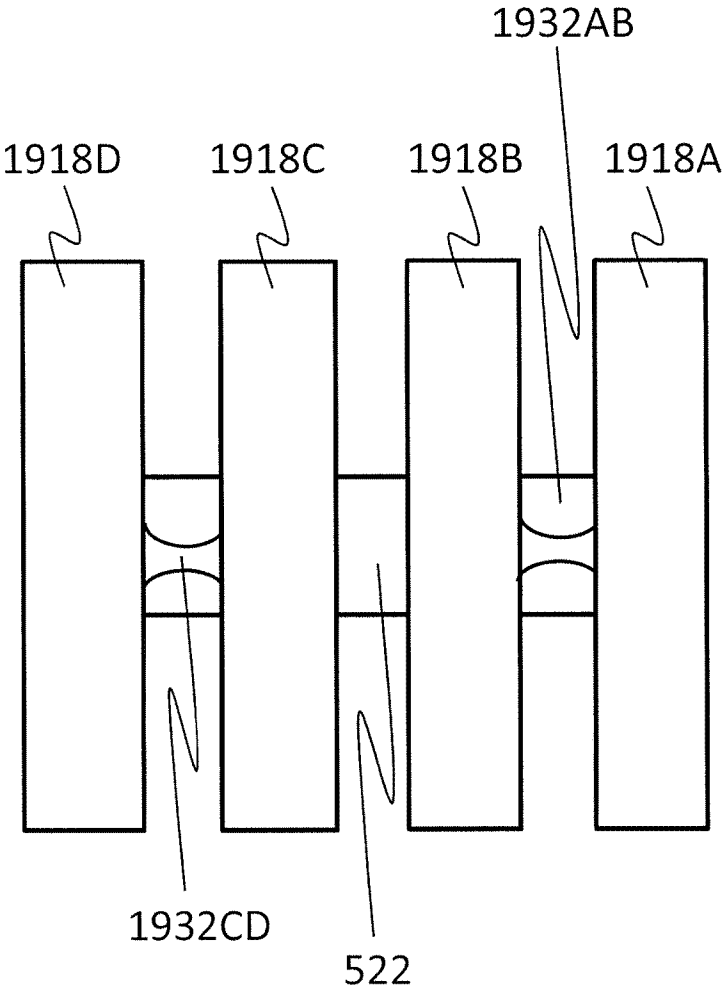
FIG. 20 is an end view of the components depicted in FIG. 19.

FIGS. 19 and 20 depict yet another alternate embodiment, where FIG. 19 corresponds to the view of FIG. 13, but FIG. 20 corresponds to a view looking from the right side towards the left side in FIG. 19. According to this embodiment, the vibratory apparatus in general, and the transverse lever arm apparatus in particular, is configured such that actuation of the actuator (e.g., the piezoelectric element 570) applies a force to at least one arm that is transmitted to one or more other arms. For example, as can be seen in FIG. 19, transverse lever arm apparatus 1910 includes a lever arm 1918A connected (e.g., mechanically coupled) to footplate 512 via hinge 522 in a manner concomitant with that of the embodiment of FIG. 13. This is also the case with respect to lever arm 1918C. Conversely, lever arm 1918B is not directly connected/coupled to footplate 512 via hinge 522. Instead it is connected to lever arm 1918A via hinge 1932AB. In a similar vein, arm 1918D is connected to arm 1918C via hinge 1932CD. Thus, the force applied to lever arm 1918A resulting from actuation of the actuator is at least partially transmitted through lever arm 1918A to lever arm 1918B via hinge 1932AB. Still further, the force applied to lever arm 1918C resulting from actuation of the actuator is at least transmitted through lever arm 1918C to lever arm 1918D via hinge 1932CD. The ramifications of this will now be described.

Embodiments of FIGS. 19 and 20 is, in essence, a serially linked lever arm arrangement. That is, the levers are linked serially to one another. While the embodiment of FIGS. 19 and 20 depicts only the serial linking of two levers, in an alternate embodiment, three or more levers can be linked serially. Any linkage that can enable the teachings detailed herein and/or variations thereof can be utilized in at least some embodiments.

In an exemplary embodiment of a serially linked lever arrangement, the swing distance of a mass (or more accurately, a center of gravity) related to a lever "downstream" in the system is increased relative to that which would be the case if the system had a single lever having an equivalent length of the combined levers.

Figure 21:
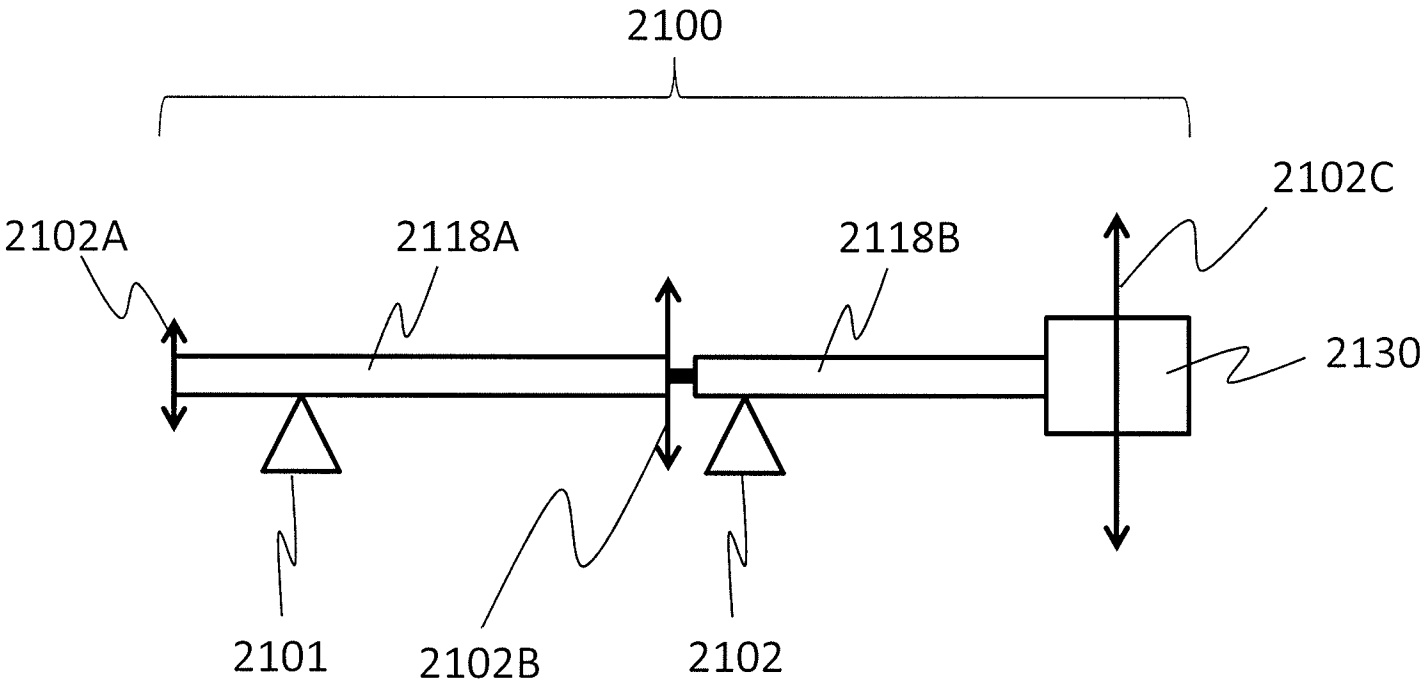
FIG. 21 is a conceptual diagram of an exemplary embodiment of a transverse lever arm apparatus.

FIG. 21 depicts a conceptual schematic illustrating this concept. In particular, there are levers 2118A and 2118B, respectively corresponding to levers 1918A and 1918B of FIG. 19, and fulcrums 2101, and 2102. Also, there is a mass 2130, located at the end of lever arm 2118B. Upon the application of a force on the left side of lever arm 2118A of sufficient magnitude to move that end by magnitude represented by arrow 2101A, the right end of the lever arm 2118A moves a distance corresponding to a magnitude represented by arrow 2102B. Because the end of lever arm 2118A is linked to the end of lever arm 2118B as shown, the movement of the end of lever arm 2118A is transferred to the opposing end of lever arm 2118B. Owing to the location of the fulcrum 2102 closer to the left end of lever arm 2118B then the right end of lever arm 2118B, the right end of lever arm 2118B, to which the mass to 130 is a fixed, moves a distance corresponding to a magnitude represented by arrow 2102C. As can be seen from the figures, the hours are progressively larger moving from left to right, representing the increase in swing distance afforded by serially linking the lever arms.

Is noted that in some embodiments of the embodiment of FIG. 19, hinge 522 corresponds to fulcrum 2101 of FIG. 21, and hinge 1932AB corresponds to fulcrum 2102 of FIG. 21. That said, in an alternate embodiment, hinge 1932AB does not correspond to fulcrum 2102, but instead, a separate fulcrum is located between the left end of lever arm 1918B and hinge 1932AB. In an exemplary embodiment, hinge 1932AB, or at least a component thereof, is configured to move relative to lever arm 1918A and/or lever arm 1918B so as to relieve or otherwise mitigate any strain that might be developed in embodiments where the additional fulcrum is "fixed" to lever arm 1918B. Any arrangement that can enable the teachings detailed herein, such as the teachings according to FIG. 21, and/or variations thereof, can be utilized in at least some embodiments.

Figure 22:
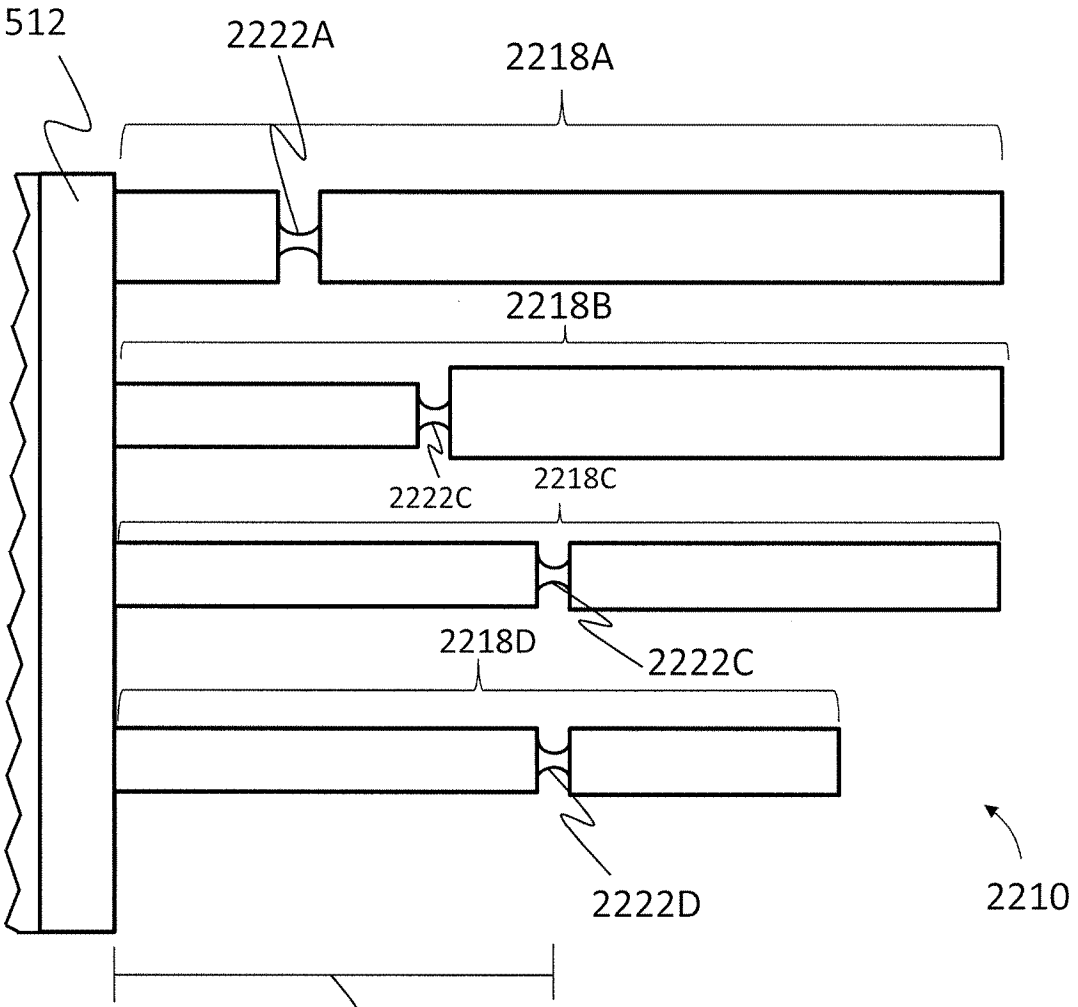
FIG. 22 is a top view of another alternate embodiment of a transverse lever arm apparatus.

FIG. 22 depicts yet an alternate embodiment of an exemplary embodiment of a transverse lever arm apparatus 2210. In this example, the hinge 522 is eliminated and hinges 2222A-D are added as shown, although in other embodiments, the hinge 522 and/or the hinges 522A-D are present as well. As can be seen, the locations of the hinges 2222A-D from the footplate 512 (distance D2) can be different in each arm 2218A-D, although the locations can be the same. In particular, a can be seen that arms 2218A, 2218B, and 2218C have hinges that are progressively located further away from the footplate 512. Conversely, arms 2218C and 2218D have hinges located at the same distance from footplate 512. However, as can be seen, the length of the portion of the arms outboard of the hinges is different between the two. In embodiments where all other things are equal with respect to the arms, this results in a different center of gravity of the portion of the arm outboard of the hinge between the two arms. Varying the location of the hinge and or the mass of the arm (or more accurately the location of the center of gravity outboard of the hinge) as shown can result in variation of the resonant frequency of each particular arm relative to that of the other.

It is further noted that in an alternate embodiment, the concept of FIG. 22 can be combined with one or more or all of the prior concepts. In this regard, by way of example only and not by way of limitation, the hinges 2222A-D can be applied as shown to the embodiments utilizing hinge 522/522A-D, etc.

Indeed, in a similar vein, it is noted that in an exemplary embodiment, there is a vibratory apparatus that includes any single teaching and/or any group of teachings and/or all teachings associated with a particular embodiment detailed herein and/or variation thereof that is combined with any other single teaching and/or any group of teachings and/or all teaching associated with another particular embodiment detailed herein and/or variation thereof. Some embodiments include vibratory apparatuses utilizing one or more or all of the teachings detailed herein and or variations thereof. Furthermore, any configuration of a vibratory apparatus that can enable the teachings detailed herein and or variations thereof to be practiced can utilize in at least some embodiments. It is further noted that any teachings detailed herein related to a method of manufacturing a vibratory apparatus and/or a component thereof corresponds to a disclosure of the results saying apparatus. Conversely, any disclosure of a component of the vibratory apparatus detailed herein and/or functionality of a vibratory apparatus detailed herein corresponds to a disclosure of a method of making a vibratory apparatus having that component/feature/functionality. Also, some embodiments include a method of utilizing the vibratory apparatus as detailed herein and/or variations thereof in a utilitarian manner, such as by way of example only and not by way of limitation, to evoke a hearing precept via bone conduction.

It is noted that in at least some embodiments, the transverse lever arm apparatus corresponds to a distributor device, where there is no particular portion that can be identified as the spring component as distinct from the mass component, at least not in a significant manner.

Figure 23:
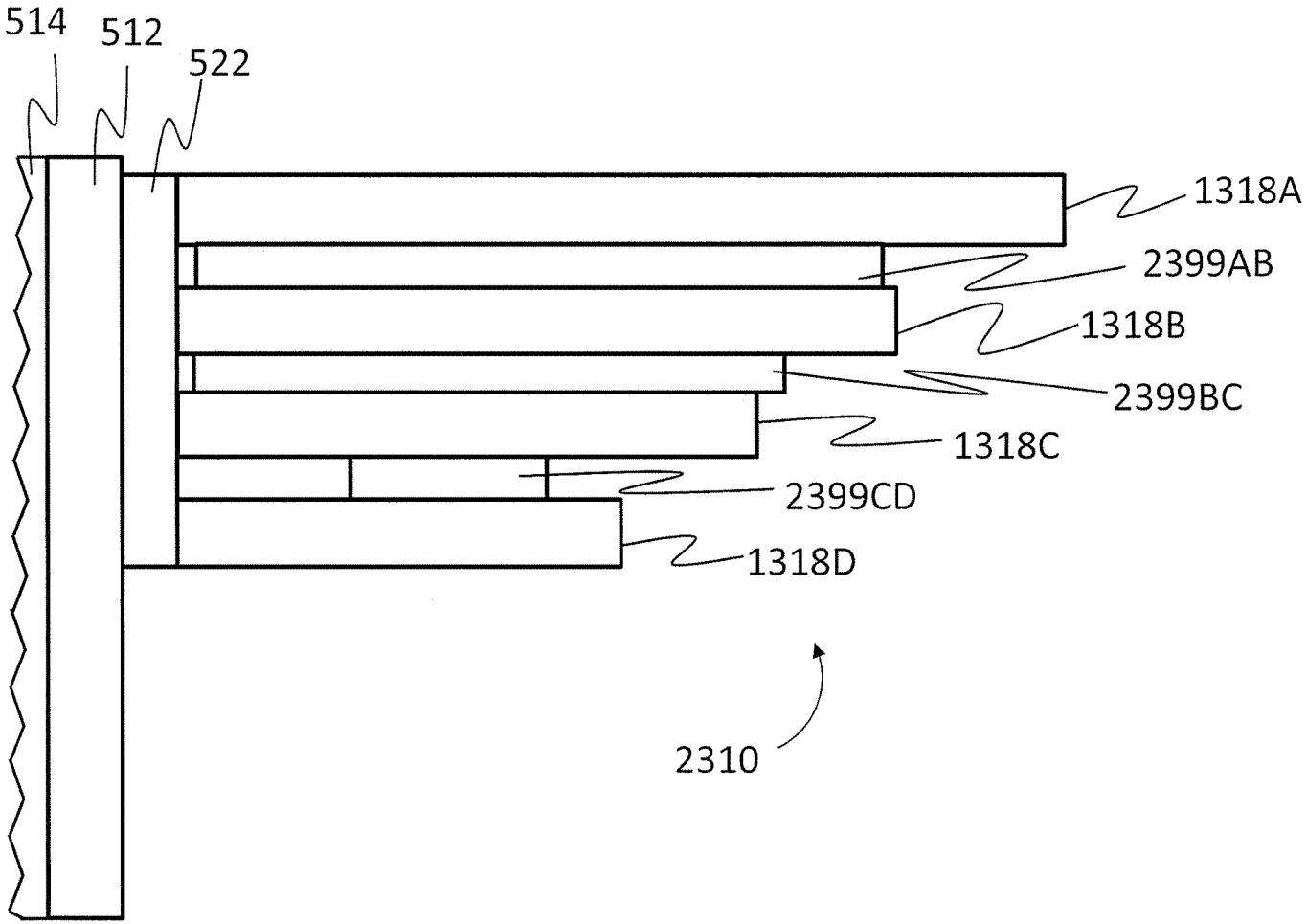
FIG. 23 is a top view of another alternate embodiment of a transverse lever arm apparatus.

FIG. 23 depicts a variation of the embodiment of FIG. 13. In particular, there is a transverse lever arm apparatus 2310 that corresponds to the structure of transverse lever arm apparatus 1310 FIG. 13, with the addition of coupling components 2399AB, 2399BC, and 2399CD located between the various lever arms as depicted. In the embodiment of FIG. 23, the coupling components constitute damping material spanning a distance from the lever arms. In an exemplary embodiment, the damping material is elastomeric material. As can be seen from FIG. 23, various configurations of the coupling components can be utilized, such as coupling components that substantially span the entire length of a given arm and/or that spanned only a fraction of the length of the arm. Any application of d coupling components that can enable the teachings detailed herein and/or variations thereof to be practiced can utilize in at least some embodiments.

In an exemplary embodiment, the specific coupling components provide spring and/or damping characteristics that are utilitarian for a designed/desired force frequency shaping. Such characteristics can be obtained, by, for example, defining the mechanical response as a rational polynomial, then optimizing the coefficients of the rational polynomial to minimize the least squared error to the desired response. An exemplary method of optimization is to use an electromechanical analogy, identifying e.g. inductors as springs, capacitors as masses, mechanical resistances as electrical conductances, and then applying for instance, the Remez exchange algorithm due to McClellan and Parks used for electronics filter design. Other methods for optimization of rational polynomials such as genetic algorithms, simulated annealing, etc. may of course be applied to the design of this, or simpler, multiarmed or merged resonant structures, and are included without limitation.

Some exemplary functionalities at least some embodiments will now be described.

At least some embodiments, any one or more of the exemplary teachings detailed herein vis-à-vis the lever arms (which includes leaf springs) can be utilized to control/impact the resonant frequency of a given lever arm, and thus the overall resonant frequency of the vibratory apparatus 553. More particularly, in an exemplary embodiment, a given lever arm is tuned to a specific frequency. In an exemplary embodiment having two or more lever arms, the respective lever arms are tuned to substantially separate frequencies. By way of example only and not by way of limitation, in an exemplary embodiment, one lever arm can be tuned to 750 Hz, while another lever arm is tuned to 1000 Hz or 1250 Hz, etc. By "tuned," it is meant that the structure of the lever arms is configured such that the lever arm has a given frequency. In this regard, "tuned" connotes structure.

Figure 24:
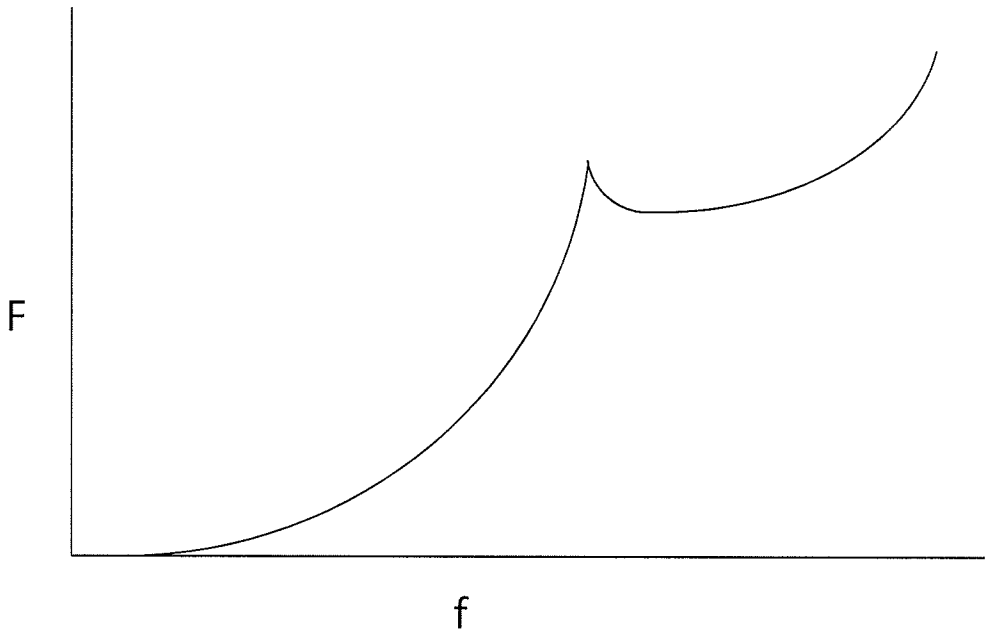
FIGS. 24 and 25 are exemplary conceptual graphs.

The use of two or more lever arms enable, in at least some embodiments, the resonant frequencies of the vibratory apparatus in general and the transverse lever arm apparatus in particular to be "smoothed," at least relative to that which would be the case in an embodiment utilizing only one transverse lever arm. More particularly, FIG. 24 depicts an exemplary force output (y-axis) to frequency (x-axis) graph of an exemplary transverse lever arm apparatus having a single lever arm. As can be seen in the exemplary transverse lever arm apparatus has a resonance peak. Force output for frequencies below that resonant peak are substantially lower. Thus, in an embodiment that attempts to at least partially harmonize force output over a range of frequencies, the energy applied to the actuator is increased, at least for frequencies below the resonant frequency, compared to that corresponding to frequencies at and/or closely proximate to the resonant frequency of the transverse lever arm apparatus.

Figure 25:
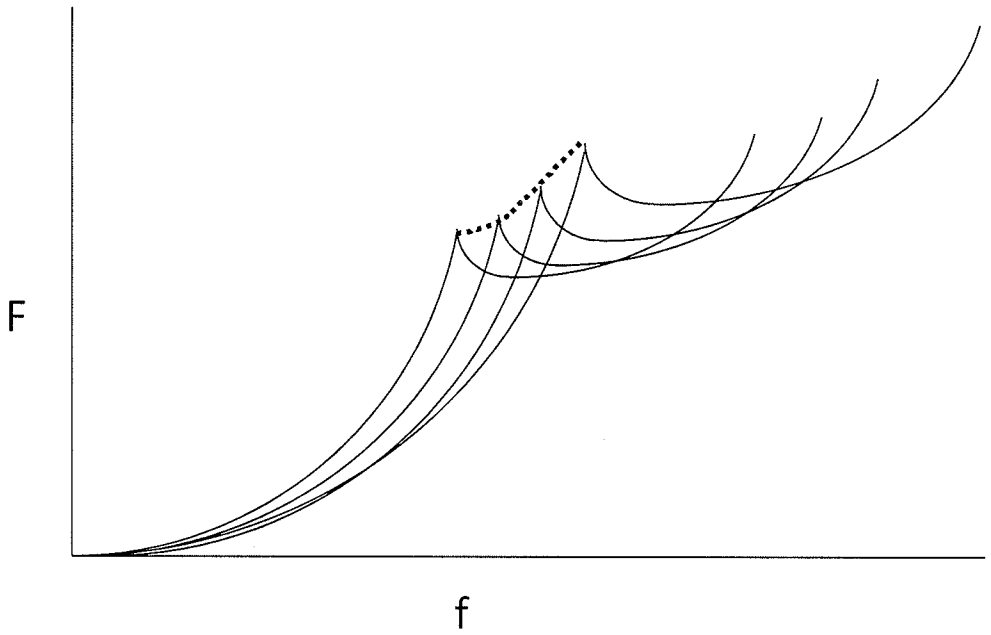

Conversely, FIG. 25 depicts an exemplary force output to frequency graph of an exemplary transverse lever arm apparatus having four lever arms. In this regard, in an exemplary embodiment, the lever arms are configured such that each has a substantially different resonant frequency. This has the conceptual effect of "smoothing" the resonant frequencies. More particularly, the effective resonant frequency of the transverse lever arm apparatus corresponds to the dashed line of FIG. 25. Accordingly, the resonant frequency of the transverse lever arm apparatus is more of a composite resonant frequency/is a combination of resonant frequencies. Because of this, the drastic drop off of the force to frequency curve is pushed to lower frequencies. More accurately, the output force for a given frequency is relatively more constant/harmonious over a range of frequencies relative to that which would be the case for a transverse lever arm apparatus utilizing a single arm. In an exemplary embodiment, the more/greater the number of lever arms, the "smoother" the frequency curve is proximate the resonant frequencies. Put another way, in an exemplary embodiment, the more/greater the number of lever arms, the wider the resonant frequency peak/the less "peaky" is the resonant frequency peak.

Accordingly in an exemplary embodiment, by utilizing a wide range of arms having different resonant frequencies, a more harmonious force output can be achieved over a range of frequencies (for a given energy input into the actuator). In an exemplary embodiment, there is thus a vibratory apparatus in general, and a transverse lever arm apparatus in particular, that effectively has no discrete resonant frequency. In an exemplary embodiment, there is thus a vibratory apparatus in general, and a transverse lever arm apparatus particular, that has a diffuse resonant frequency.

In view of the above, there is a device, including a vibratory apparatus having an actuator, such as the piezoelectric element 570 detailed above, configured to generate vibrations upon actuation of the actuator. The vibratory apparatus includes an effectively continuous spectrum of structural resonant frequencies. By structural resonant frequencies, it is meant resonant frequencies of the structure as opposed to a resonant frequency which exists due to signal processing and/or transducer adjustments. In an exemplary embodiment, the spectrum of structural resonant frequencies extends from at least about 750 Hz to about 900 Hz.

In an exemplary embodiment, the arms have respective resonant frequencies from between (and including) about 250 Hz to about 2000 Hz. By way of example only and not by way of limitation, in an exemplary embodiment that utilizes, for example, 10 arms, the first arm may have a resonant frequency of 250 Hz, the second arm may have a resonant frequency of 400 Hz, the third arm may have a resonant frequency of 550 Hz, etc., in increments of about 150 Hz up to 1750 Hz. Alternatively, by way of example only and not by way of limitation, in an exemplary embodiment that utilizes, for example four arms, the first arm may have a resonant frequency of about 400 Hz, the second arm may have a resonant frequency of 700 Hz, third arm may have a resonant frequency of 1000 Hz, and the fourth arm may have a resonant frequency of 1300 Hz. That said, in an alternate embodiment, the increase in resonant frequency between arms is not linear. By way of example only and not by way of limitation, in an exemplary embodiment, the first arm may have a resonant frequency of about 600 Hz, the second arm may have a resonant frequency of about 800 Hz, the third arm may have a resonant frequency of about 900 Hz, and the fourth arm may have a resonant frequency of about 1000 Hz.

In an exemplary embodiment there is a transverse lever arm apparatus having 2 or more lever arms in increments of one lever arm, up to about 40 lever arms (e.g., 7 lever arms, 13 lever arms, 19 lever arms, etc.) or more, where any given lever arm has a resonant frequency of between (and including) about 250 Hz to about 3000 Hz in 10 Hz increments (e.g., about 250 Hz, about 340 Hz, about 990 Hz, about 2980 Hz.)

Accordingly, there is an exemplary embodiment that at least partially harmonizes force output over range of frequencies for a given unit of energy input into the actuator. In an exemplary embodiment, there is a vibratory apparatus such that, for a given unit of energy input into the actuator, the output force per frequency curve over a range of frequencies encompassing a band extending over 10 Hz to about 500 Hz or any value or range of values in about 10 Hz increments (e.g., the range is in a band extending over 130 Hz, 200 Hz, 250 Hz, 400 Hz, etc.) is such that the output force varies no more than 1% to 30% or any value therebetween in 1% increments (e.g., 10%, 13%, 25%, etc.) In an exemplary embodiment, there is a vibratory apparatus such that, for a given unit of energy input into the actuator, the output force per frequency curve over a range of frequencies encompassing a band extending over 10 Hz to about 500 Hz or any value or range of values in about 10 Hz increments (e.g., the range is in a band extending over 130 Hz, 200 Hz, 250 Hz, 400 Hz, etc.) is such that the output force varies no more than about 0.1 dB to about 4 dB or any value therebetween in 0.01 dB increments (e.g., 1.3 dB, 3 dB, etc.) Accordingly, in an exemplary embodiment, there is a vibratory apparatus having, for a given unit of energy input into the actuator, an output force per frequency curve over a range of frequencies encompassing a band extending over 150 Hz (e.g., from 750 Hz to 900 Hz) such that the output force varies no more than about 3 dB over that range.

In view of the above, it can be seen that exemplary embodiments of the transverse lever arm apparatus are such that it distributes force and output of the vibratory apparatus to a wider range of frequencies than that would be the case with respect to a transverse lever arm apparatus utilizing a single arm. That is, in an exemplary embodiment, there is a vibratory apparatus that distributes energy over a range of frequencies, such as any of the ranges of frequencies detailed herein.

In an exemplary embodiment, there is a method of manufacturing a vibratory apparatus according to the teachings detailed herein and/or variations thereof, where the vibratory apparatus is customized to an individual recipient. In an exemplary method, the method entails identifying output frequencies of the vibratory apparatus having a utilitarian effect on the recipient vis-à-vis evoking a hearing percept. In an exemplary embodiment, this can be relative. By way of example only and not by way of limitation, in an exemplary embodiment, the method entails determining that a transverse lever arm apparatus having a force output according to the teachings detailed herein and/or variations thereof over range of frequencies that varies no more than a given percentage over those frequencies, at least for a given unit of energy input into the actuator, has utilitarian value. Upon determining such, the arms of the transverse lever apparatus are configured in a manufacturing process such that the resulting vibratory apparatus has those characteristics. In an exemplary embodiment, the transverse lever arms are configured according to any of the teachings detailed herein and or variations thereof.

In an alternate embodiment, a statistical sampling of a populace is obtained, and the transverse lever arm apparatus is manufactured to meet the pertinent utilitarian functionalities for that populace.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A device, comprising:

a vibratory apparatus having an actuator configured to generate vibrations upon actuation of the actuator, including:

a plurality of lever arms, wherein the vibratory apparatus is configured such that at least a respective portion of respective lever arms of the plurality of lever arms move about at least one of a single or a respective hinge when the vibratory apparatus is generating vibrations, wherein the device is a hearing prosthesis configured to evoke a bone conduction hearing percept based on captured sound via the generated vibrations, and a first and second respective lever arms of the plurality of lever arms are separately supported relative to one another.

2. The device of claim 1, wherein:

the respective portions of respective lever arms of the plurality of lever arms move about a single hinge directly contacting the respective lever arms when the vibratory apparatus is generating vibrations.

3. The vibratory apparatus of claim 1, wherein:

the respective portions of respective lever arms of the plurality of lever arms move about respective hinges when the vibratory apparatus is generating vibrations.

4. The device of claim 1, further comprising one or more additional lever arms in addition to the plurality of lever arms, wherein the vibratory apparatus is configured such that at least a respective portion of respective lever arm(s) of the additional lever arm(s) move about at least one of an additional single or an additional respective hinge when the vibratory apparatus is generating vibrations, wherein the device is configured such that the actuator is a single actuator that actuation thereof moves all of the lever arms of the plurality of lever arms and the one or more additional lever arms.

5. The device of claim 1, wherein:

at least one of the hinges is a living hinge.

6. The device of claim 1, wherein:

a first lever arm of the plurality of lever arms is supported by a first hinge;

a second lever arm of the plurality of lever arms is supported by a second hinge;

the second lever arm is mechanically coupled to the first lever arm such that actuation of the actuator applies a force to the first lever arm that is transmitted at least partially therethrough to the second lever arm.

7. The device of claim 1, further comprising:

a foot plate, wherein the at least one of a single or a respective hinge is supported by the foot plate.

8. The device of claim 1, further comprising:

a foot plate, wherein the at least one of a single or a respective hinge is supported by the foot plate, wherein the foot plate is supported by a housing of the device via a hinge on an opposite side of the foot plate from the at least one of a single or a respective hinge.

9. The device of claim 1, wherein:

respective lever arms of the plurality of lever arms are of a same general shape.

10. A device, comprising:

a vibratory apparatus having an actuator configured to generate vibrations upon actuation of the actuator, including:

a plurality of lever arms, the plurality of lever arms including at least two lever arms that have respective centers of mass that are at respective different locations relative to respective distance in a longitudinal direction from respective supported ends of the respective lever arms, wherein the vibratory apparatus is configured such that respective lever arms of the plurality of lever arms resonate independently from each other when the vibratory apparatus is generating vibrations.

11. The device of claim 10, wherein:

the actuator is a piezoelectric transducer configured to expand and contract in the longitudinal direction during actuation.

12. The device of claim 10, wherein:

the plurality of lever arms includes a first lever arm tuned to a first frequency and a second lever arm tuned to a second frequency, wherein the first frequency is substantially different than the second frequency.

13. The device of claim 12, wherein:

the plurality of lever arms are respectively tuned independently from all transducers of the actuator.

14. The device of claim 10, wherein:

the plurality of lever arms include at least one lever arm that is flexibly anisotropic.

15. The device of claim 10, wherein:

the plurality of lever arms are part of a monolithic component.

16. The device of claim 10, further comprising:

a coupling material spanning a distance from first lever arm of the plurality of lever arms to a second lever arm of the plurality of lever arms.

17. The device of claim 16, wherein the coupling material is at least one of a damping material or an elastic material.

18. The device of claim 10, wherein:

the vibratory apparatus is configured such that force generated by the actuator is applied equally to the lever arms of the plurality of lever arms, wherein the force is generated at a location remote from the lever arms of the plurality of lever arms.

19. The device of claim 10, wherein:

the plurality of lever arms extend in a same direction from a same side of the device and are linked to each other such that a force that moves one of the plurality of lever arms moves the remaining of the plurality of lever arms.

20. The device of claim 10, wherein:

the actuator outputs force that moves the lever arms, thus generating the vibrations.

21. A device, comprising:

a vibratory apparatus having an actuator configured to generate vibrations upon actuation of the actuator, the vibratory apparatus including an effectively continuous spectrum of structural resonant frequencies.

22. The device of claim 21, wherein:

the spectrum of structural resonant frequencies extends from at least about 750 Hz to about 900 Hz.

23. The device of claim 21, wherein:

the device includes a plurality of lever arms, wherein the device is configured such that respective portions of respective lever arms move independently about a common hinge or one or more respective hinges, thereby generating vibrations.

24. The device of claim 23, wherein:

the common hinge and the one or more respective hinges are living hinges vis-à-vis the lever arms.

25. The device of claim 21, wherein:

the device includes a plurality of lever arms attached to a foot plate, wherein the device is configured with an actuator that is configured to apply a force to the foot plate to move the foot plate and thus move the plurality of lever arms.

26. The device of claim 21, wherein:

the device includes a plurality of lever arms that have a major direction of extension parallel to one another in a same direction.

27. The device of claim 21, wherein:

the device includes a plurality of lever arms having respective resonant frequencies.

28. The device of claim 21, wherein:

the actuator is configured to, when actuated, move components of the vibratory apparatus to generate the vibrations.

29. The device of claim 21, wherein:

the device includes a sound processor;

the sound processor is configured to process captured sound and output a signal based on the captured sound;

the actuator is configured to actuate based on the outputted signal from the sound processor to generate the vibrations.

* * * * *